US011390482B2

(12) United States Patent
Endo

(10) Patent No.: US 11,390,482 B2
(45) Date of Patent: Jul. 19, 2022

(54) SHEET PROCESSING APPARATUS AND IMAGE FORMING SYSTEM

(71) Applicant: CANON KABUSHIKI KAISHA, Tokyo (JP)

(72) Inventor: Takahiro Endo, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/190,564

(22) Filed: Mar. 3, 2021

(65) Prior Publication Data

US 2021/0284480 A1 Sep. 16, 2021

(30) Foreign Application Priority Data

Mar. 10, 2020 (JP) ..... JP2020-041338

(51) Int. Cl.
*B65H 35/00* (2006.01)

(52) U.S. Cl.
CPC ..... *B65H 35/0086* (2013.01)

(58) Field of Classification Search
None
See application file for complete search history.

(56) References Cited

U.S. PATENT DOCUMENTS

| | | | | |
|---|---|---|---|---|
| 7,744,074 | B2 * | 6/2010 | Iguchi | B65H 35/00 270/58.01 |
| 7,890,046 | B2 | 2/2011 | Hanada et al. | |
| 8,770,073 | B2 * | 7/2014 | Fukatsu | B26F 1/0092 83/13 |
| 8,998,192 | B2 * | 4/2015 | Yoshida | B26D 5/00 270/58.07 |
| 9,329,555 | B2 * | 5/2016 | Motoi | B65H 35/04 |
| 2021/0011417 | A1 | 1/2021 | Endo | |

FOREIGN PATENT DOCUMENTS

| | | | |
|---|---|---|---|
| JP | H10-279170 | A | 10/1998 |
| JP | 2005-274772 | A | 10/2005 |
| JP | 2006-016131 | A | 1/2006 |

* cited by examiner

*Primary Examiner* — Leslie A Nicholson, III
(74) *Attorney, Agent, or Firm* — Venable LLP

(57) ABSTRACT

A sheet processing apparatus includes a sheet conveyance portion, a punching member, a punching member moving portion, a position detection portion, and a controller. In a case of performing a punching process on a preceding sheet and a succeeding sheet successively conveyed to a predetermined position, the controller is configured to execute preliminary movement after the punching process on the preceding sheet is finished and before an end portion position of the succeeding sheet in a sheet width direction that coincides with a first punching position of the succeeding sheet in a conveyance direction reaches the position detection portion. The first punching position is a position where the punching process is first performed on the succeeding sheet.

22 Claims, 13 Drawing Sheets

SHEET PROCESSING APPARATUS AND IMAGE FORMING SYSTEM

BACKGROUND OF THE INVENTION

Field of the Invention

The present invention relates to a sheet processing apparatus that processes a sheet and an image forming system including the sheet processing apparatus.

Description of the Related Art

Conventionally, a finisher that is connected to an image forming apparatus such as a printer and performs a punching process on a sheet discharged from the image forming apparatus is proposed, for example, in Japanese Patent Laid-Open No. H10-279170. This finisher includes a sheet detection sensor that detects the sheet, a conveyance roller pair that conveys the sheet, and a punching device that punches a hole in the sheet conveyed by the conveyance roller pair. The punching device includes a puncher and a die that are each rotatably supported by a casing, and a puncher driving motor that drives the puncher and the die in synchronization.

In addition, in Japanese Patent Laid-Open No. H10-279170, after the leading end of the sheet is detected by the sheet detection sensor, an end portion position in a width direction of the sheet perpendicular to a sheet conveyance direction is detected by a sheet side end detection sensor at a predetermined timing, and the punching device is moved in the width direction on the basis of the detected information.

In recent years, for the image forming apparatus, there has been a demand that the interval between the trailing end of a preceding sheet and the leading end of a succeeding sheet be shortened to improve the productivity. This interval will be hereinafter referred to as a sheet interval. Here, Japanese Patent Laid-Open No. H10-279170 does not disclose how the punching device is controlled before and after the sheet interval. However, in the case where a punching position of the succeeding sheet is greatly displaced from a punching position of the preceding sheet or where the sheet is conveyed in a skewed state, the amount of movement of the punching device in the width direction for performing the punching process on the succeeding sheet after the punching process on the preceding sheet is finished is large. Therefore, in such a case, it is difficult to perform the punching process successively on a plurality of sheets with a short sheet interval.

SUMMARY OF THE INVENTION

The present invention provides a configuration that may improve the productivity in the case of successively performing a punching process on sheets.

According to a first aspect of the present invention, a sheet processing apparatus includes a sheet conveyance portion configured to convey a sheet in a conveyance direction, a punching member that is rotatably supported and configured to perform a punching process of punching a hole in the sheet conveyed by the conveyance portion in a predetermined position in the conveyance direction, a punching member moving portion configured to move the punching member in a sheet width direction perpendicular to the conveyance direction, a position detection portion disposed upstream of the predetermined position in the conveyance direction and configured to detect an end portion position of the sheet in the sheet width direction, and a controller configured to control the punching member moving portion to move the punching member to a position to punch the hole in the sheet. In a case of performing the punching process on a preceding sheet and a succeeding sheet successively conveyed to the predetermined position, the controller is configured to execute preliminary movement after the punching process on the preceding sheet is finished and before an end portion position of the succeeding sheet in the sheet width direction that coincides with a first punching position of the succeeding sheet in the conveyance direction reaches the position detection portion. In the preliminary movement, movement of the punching member in the sheet width direction is started for performing the punching process on the succeeding sheet. The first punching position is a position where the punching process is first performed on the succeeding sheet.

According to a second aspect of the present invention, a sheet processing apparatus includes a sheet conveyance portion configured to convey a sheet in a conveyance direction, a punching member that is rotatably supported and configured to perform a punching process of punching a hole in the sheet conveyed by the conveyance portion in a predetermined position in the conveyance direction, a punching member moving portion configured to move the punching member in a sheet width direction perpendicular to the conveyance direction, a position detection portion disposed upstream of the predetermined position in the conveyance direction and configured to detect an end portion position of the sheet in the sheet width direction, and a controller configured to control the punching member moving portion to move the punching member to a position to punch the hole in the sheet. In a case of performing the punching process on a preceding sheet and a succeeding sheet successively conveyed to the predetermined position, the controller starts moving the punching member in the sheet width direction to perform the punching process on the succeeding sheet, after the punching process on the preceding sheet is finished and before an end portion position of the succeeding sheet in the sheet width direction that coincides with a first punching position of the succeeding sheet in the conveyance direction reaches the position detection portion, in a case where a distance from a position of the punching member at an end of the punching process on the preceding sheet to the first punching position of the succeeding sheet in the sheet width direction is larger than a predetermined threshold value, the first punching position being a position where the punching process is first performed on the succeeding sheet, and starts moving the punching member in the sheet width direction to perform the punching process on the succeeding sheet, after the end portion position of the succeeding sheet in the sheet width direction that coincides with the first punching position of the succeeding sheet in the conveyance direction reaches the position detection portion, in a case where the distance from the position of the punching member at the end of the punching process on the preceding sheet to the first punching position of the succeeding sheet in the sheet width direction is equal to or smaller than the predetermined threshold value.

Further features of the present invention will become apparent from the following description of exemplary embodiments with reference to the attached drawings.

DESCRIPTION OF THE EMBODIMENTS

First Embodiment

A first embodiment will be described with reference to FIGS. 1 to 9E. First, an image forming system of the present embodiment will be described with reference to FIG. 1.

Image Forming System

Figure 1:
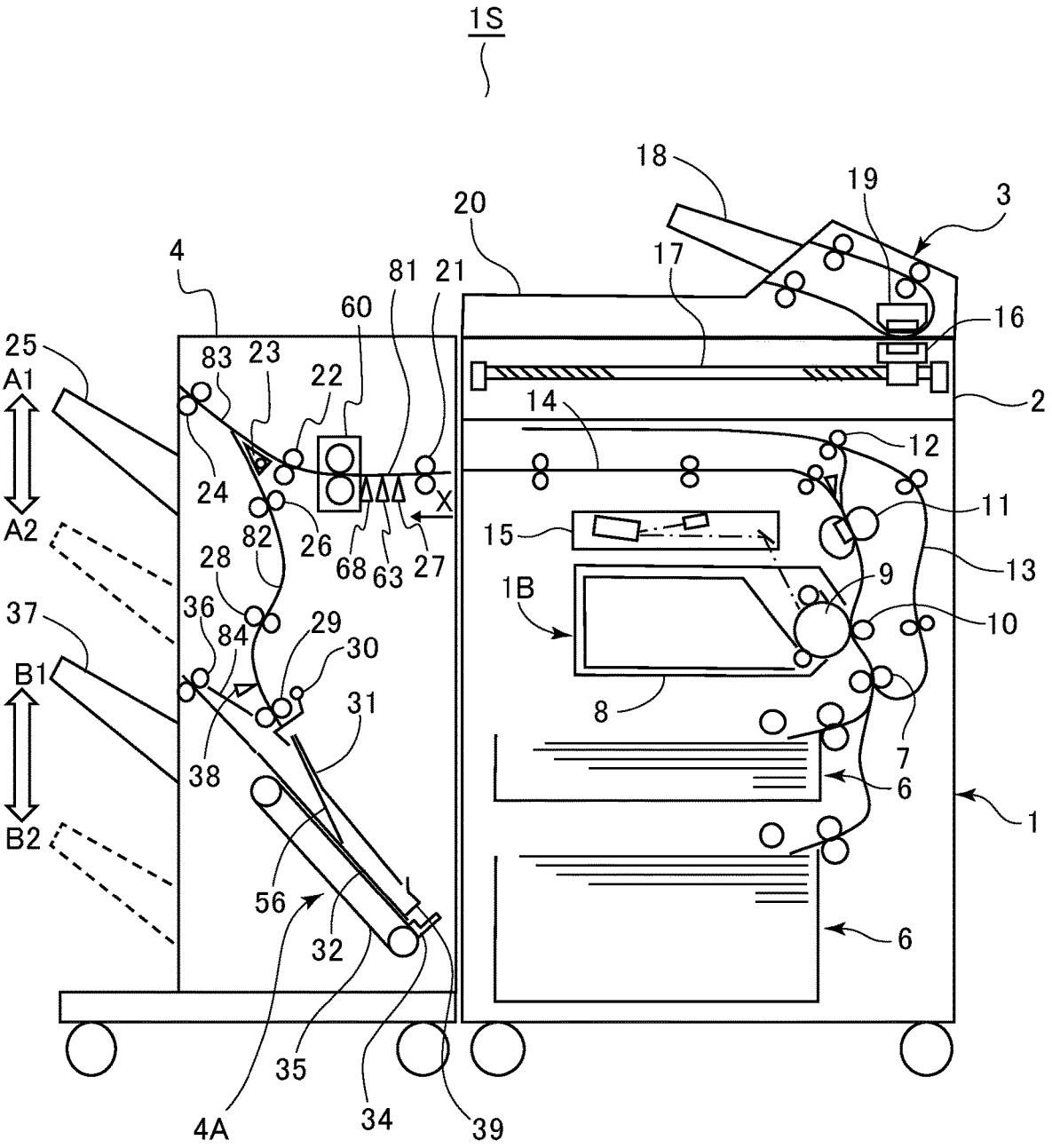
FIG. 1 is an overall schematic view of an image forming apparatus according to a first embodiment.

As illustrated in FIG. 1, an image forming system 1S according to the present embodiment is constituted by an image forming apparatus 1, an image reading apparatus 2, a document feeding apparatus 3, and a sheet processing apparatus 4. The image forming system 1S forms an image on a sheet serving as a recording material, and outputs the sheet after processing the sheet by the sheet processing apparatus 4 if necessary. To be noted, examples of the sheet include paper sheets and plastic sheets. Hereinafter, the operation of each apparatus will be schematically described, and then the sheet processing apparatus 4 will be described in detail.

The document feeding apparatus 3 conveys a document placed on a document tray 18 to image reading portions 16 and 19. The image reading portions 16 and 19 are each an image sensor that reads image information from a document surface, and both surfaces of the document are read in one time of document conveyance. The document whose image information has been read is discharged onto a document discharge portion 20. In addition, the image reading apparatus 2 is capable of reading the image information from a still document set on a platen glass by reciprocating the image reading portion 16 by a driving device 17. Examples of the still document include a document such as a booklet document to which the document feeding apparatus 3 is not applicable.

The image forming apparatus 1 is an electrophotographic apparatus including an image forming portion 1B of a direct transfer system. The image forming portion 1B includes a cartridge 8 including a photosensitive drum 9, and a laser scanner unit 15 disposed above the cartridge 8. In the case of performing an image forming operation, the surface of the photosensitive drum 9 that is rotating is charged, the laser scanner unit 15 exposes the photosensitive drum 9 on the basis of the image information, and thus an electrostatic latent image is formed on the surface of the photosensitive drum 9. The electrostatic latent image born on the photosensitive drum 9 is developed into a toner image with charged toner particles, and the toner image is conveyed to a transfer portion where the photosensitive drum 9 is opposed to a transfer roller 10. A controller of the image forming apparatus 1 performs the image forming operation by the image forming portion 1B on the basis of the image information read by the image reading portions 16 and 19 or image information received from an external computer via a network.

The image forming apparatus 1 includes a plurality of feeding apparatuses 6 that each feed sheets serving as recording media one by one at predetermined intervals. A sheet fed from a feeding apparatus 6 is conveyed to the transfer portion after the skew thereof is corrected by registration rollers 7, and the toner image born on the photosensitive drum 9 is transferred thereto in the transfer portion. A fixing unit 11 is disposed downstream of the transfer portion in the sheet conveyance direction. The fixing unit 11 includes a rotary member pair that nips and conveys the sheet, and a heat generation member such as a halogen lamp for heating the toner image, and performs an image fixing process by heating and pressurizing the toner image on the sheet.

In the case of discharging the sheet on which an image has been formed to the outside of the image forming apparatus 1, the sheet having passed through the fixing unit 11 is conveyed to the sheet processing apparatus 4 through a horizontal conveyance portion 14. In the case of a sheet on a first surface of which an image has been formed in duplex printing, the sheet having passed through the fixing unit 11 is passed onto reverse conveyance rollers 12, switched back and conveyed by the reverse conveyance rollers 12, and conveyed again to the registration rollers 7 through a reconveyance portion 13. Then, the sheet passes through the transfer portion and the fixing unit 11 again, thus an image is formed on a second surface of the sheet, and then the sheet is conveyed to the sheet processing apparatus 4 through the horizontal conveyance portion 14.

The image forming portion 1B described above is an example of an image forming portion that forms an image on a sheet, and an electrophotographic unit of an intermediate transfer system that transfers a toner image formed on a photosensitive member onto a sheet via an intermediate transfer member may be used. In addition, a printing unit of an inkjet system or an offset printing system may be used as the image forming portion.

Sheet Processing Apparatus

The sheet processing apparatus 4 includes a punching device 60 that performs a punching process on the sheet. The sheet processing apparatus 4 performs the punching process on sheets received from the image forming apparatus 1, and discharges the sheets as a sheet bundle. In addition, the sheet processing apparatus 4 can also simply discharge the sheets received from the image forming apparatus 1 without performing the punching process.

The sheet processing apparatus 4 includes an inlet path 81, an in-body discharge path 82, a first discharge path 83, and a second discharge path 84 as conveyance paths for conveying sheets, and includes an upper discharge tray 25 and a lower discharge tray 37 as discharge destinations to which the sheets are to be discharged. The inlet path 81 serving as a first conveyance path is a conveyance path for receiving and guiding a sheet from the image forming apparatus 1, and the in-body discharge path 82 extending downward from the inlet path 81 and serving as a second conveyance path is a conveyance path for guiding the sheet toward an alignment portion 4A. The first discharge path 83 is a conveyance path through which the sheet is discharged onto the upper discharge tray 25, and the second discharge path 84 serving as a third conveyance path extends from an intermediate supporting portion 39 toward bundle discharge rollers 36 and guides the sheet toward the bundle discharge roller 36.

The sheet discharged from the horizontal conveyance portion 14 of the image forming apparatus 1 is received by inlet rollers 21 disposed in the inlet path 81 and serving as a conveyance portion, and is conveyed in a sheet conveyance direction X toward pre-reverse conveyance rollers 22 through the inlet path 81. A punching device 60 is disposed between the inlet rollers 21 and the pre-reverse conveyance rollers 22 in the sheet conveyance direction X, and the sheet conveyed in the inlet path 81 is subjected to a punching process by the punching device 60 that will be described later. In addition, an entrance sensor 27 changes the output value thereof on the basis of presence or absence of a sheet in a second detection position between the inlet rollers 21 and the pre-reverse conveyance rollers 22. Examples of the output value include a voltage value and an output signal. The entrance sensor 27 serving as a second sensor is positioned upstream of a line sensor 68 and a pre-puncher sensor 63 that will be described later in the conveyance direction X. The pre-reverse conveyance rollers 22 convey the sheet received from the inlet rollers 21 toward the first discharge path 83.

To be noted, the sheet conveyance speed of the inlet rollers 21 may be set to be higher than that in the horizontal conveyance portion 14 such that the sheet conveyance speed increases after the sheet is received by the inlet rollers 21. In this case, it is preferable that a one-way clutch is disposed between a conveyance roller of the horizontal conveyance portion 14 and a motor that drives this conveyance roller such that the conveyance roller idles when the sheet is pulled by the inlet rollers 21.

In the case where the discharge destination of the sheet is the upper discharge tray 25, the reverse conveyance rollers 24 discharge the sheet received from the pre-reverse conveyance rollers 22 onto the upper discharge tray 25. In the case where the discharge destination of the sheet is the lower discharge tray 37, the reverse conveyance rollers 24 serving as a reverse conveyance portion perform switch-back conveyance of reversing the sheet received from the pre-reverse conveyance rollers 22, and convey the sheet to the in-body discharge path 82. A non-return flap 23 is disposed in a branching portion which is upstream of the reverse conveyance rollers 24 in the sheet discharge direction of the reverse conveyance rollers 24 and where the inlet path 81 and the in-body discharge path 82 branch from the first discharge path 83. The non-return flap 23 has a function of suppressing the sheet switched back by the reverse conveyance rollers 24 returning to the inlet path 81.

In-body discharge rollers 26, intermediate conveyance rollers 28, and kick-out rollers 29 that are disposed in the in-body discharge path 82 convey the sheet received from the reverse conveyance rollers 24 toward the alignment portion 4A while sequentially passing the sheet onto one another. A pre-intermediate supporting sensor 38 detects the sheet at a position between the intermediate conveyance rollers 28 and the kick-out rollers 29. As the entrance sensor 27, the pre-puncher sensor 63, and the pre-intermediate supporting sensor 38, for example, optical sensors that detect the presence or absence of a sheet in a detection position by using light, or flag sensors that use a flag pressed by the sheet are used.

The alignment portion 4A includes a bundle pressing flag 30, an intermediate supporting portion 39 serving as a supporting portion, a bundle discharge guide 34, and a driving belt 35. The intermediate supporting portion 39 is constituted by an intermediate upper guide 31 and an intermediate lower guide 32, and a plurality of sheets are supported thereon as a sheet bundle. The sheet bundle discharged toward the intermediate supporting portion 39 by the kick-out rollers 29 constituted by a roller pair is pressed against the intermediate lower guide 32 by the bundle pressing flag 30.

Then, the sheet bundle discharged onto the intermediate supporting portion 39 is guided downward along the intermediate lower guide 32, and is aligned by a longitudinal aligning plate provided at a downstream end portion of the intermediate supporting portion 39 in the sheet conveyance direction. In addition, the sheet bundle aligned by the longitudinal aligning plate in the sheet conveyance direction is aligned in a width direction perpendicular to the sheet conveyance direction by unillustrated lateral aligning plates. After such an alignment process is performed, the sheet bundle is pushed out by the bundle discharge guide 34 fixed to the driving belt 35, and is passed onto the bundle discharge rollers 36 through the second discharge path 84. The sheet bundle is discharged to the outside of the apparatus by the bundle discharge rollers 36 serving as a discharge portion, and is supported on the lower discharge tray 37.

The upper discharge tray 25 and the lower discharge tray 37 are both movable in the up-down direction with respect to the casing of the sheet processing apparatus 4. The sheet processing apparatus 4 includes sheet surface detection sensors that respectively detect the positions of the upper surface of the sheets on the upper discharge tray 25 and the lower discharge tray 37, that is, the height of sheet stacks on the upper discharge tray 25 and the lower discharge tray 37, and when either of the sensors detects a sheet, the corresponding tray is lowered in an A2 direction or a B2 direction. In addition, when a sheet surface detection sensor detects that sheets on the upper discharge tray 25 or the lower discharge tray 37 have been removed, the corresponding tray is lifted in an A1 or B1 direction. Therefore, the upper discharge tray 25 and the lower discharge tray 37 are controlled to ascend and descend so as to maintain the upper surface of the sheets supported thereon at a constant height.

Punching Device

Figures 2A, 2B, 2C, 2D:
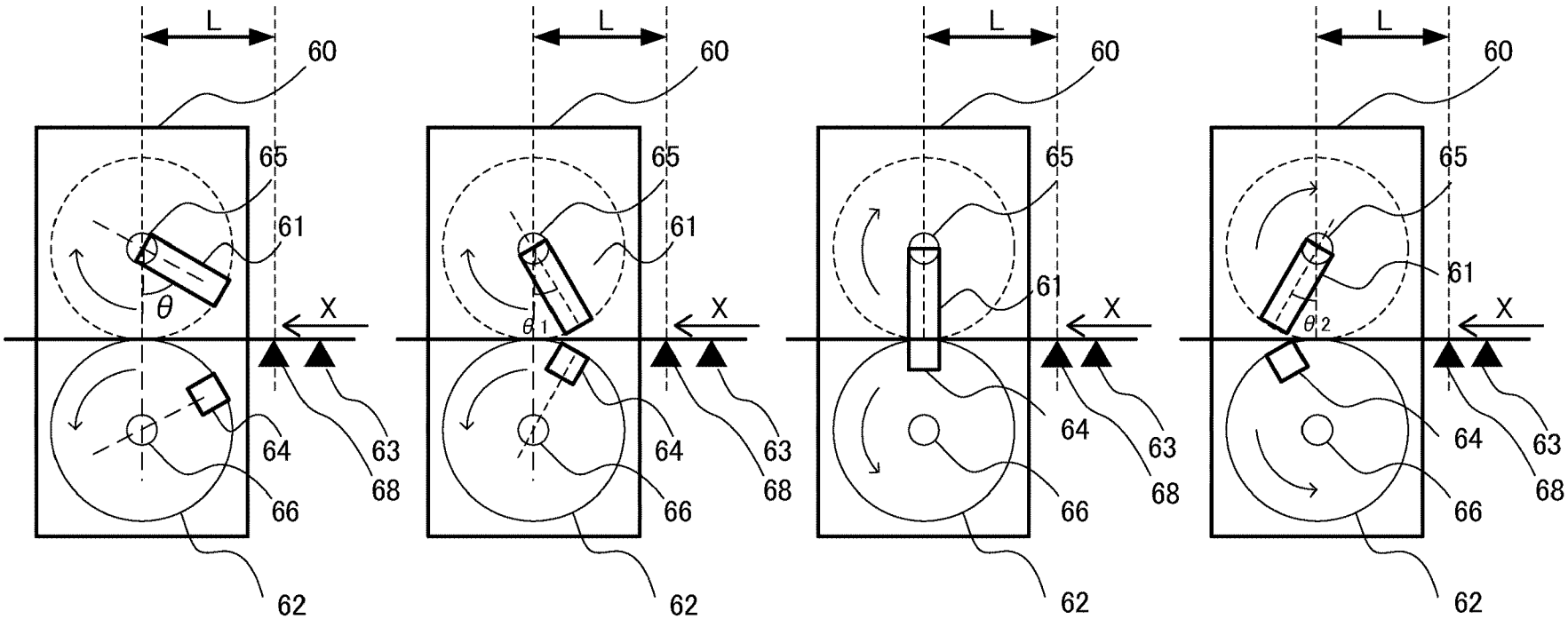
FIG. 2A is a schematic view of a puncher and a die positioned in home positions.
FIG. 2B is a schematic view of the puncher and the die positioned in punching starting positions.
FIG. 2C is a schematic view of the puncher and the die positioned in engagement positions.
FIG. 2D is a schematic view of the puncher and the die positioned in punching finishing positions.

Next, the punching device 60, the line sensor 68, and the pre-puncher sensor 63 will be described. The punching device 60 is a punching device of a rotary type that punches a hole in a sheet by a rotating puncher serving as a punching member. The punching device 60 includes a puncher 61 rotatably supported about a puncher shaft 65 and a die 62 that rotates about a die shaft 66 as illustrated in FIG. 2A. The puncher 61 performs a punching process of punching a hole in the sheet conveyed by the inlet rollers 21 illustrated in FIG. 1 at a predetermined position while rotating together with the die 62.

The pre-puncher sensor 63 and the line sensor 68 are disposed upstream of the punching device 60 in the conveyance path, that is, upstream of the punching device 60 in the sheet conveyance direction X. The die 62 has a die hole 64 capable of engaging with the puncher 61, and the puncher shaft 65 and the die shaft 66 are engaged with an unillustrated gear that is driven by a puncher driving motor 102 illustrated in FIG. 4. When the puncher driving motor 102 serving as a drive source drives, the puncher 61 rotates in a clockwise direction in FIG. 2A and the die 62 rotates in a counterclockwise direction in FIG. 2A.

The pre-puncher sensor 63 serving as a first sensor and a sheet leading end detection portion detects the sheet at a first detection position upstream of the puncher 61 and the die 62 in the conveyance direction X. More specifically, the pre-puncher sensor 63 changes the output value thereof, for example, a voltage value or an output signal, on the basis of presence or absence of the sheet in the first detection position, and therefore the output value changes when the leading end or the trailing end of the sheet passes the detection position.

The line sensor 68 serving as a position detection portion is a sensor in which a plurality of image sensors such as charge coupled device sensors: CCD sensors or complementary metal oxide semiconductor sensors: CMOS sensors are arranged in line in a sheet width direction Y, that is, a lateral direction perpendicular to the conveyance direction X. Such a line sensor 68 is disposed upstream of a predetermined position in the conveyance direction X where the punching device 60 performs the punching process, and is capable of detecting the position of an end portion position of the sheet in the width direction Y. That is, the line sensor 68 detects the end portion position of the sheet by using the fact that the detection result of the sensor differs between a position where the sheet is present and a position where the sheet is not present. In addition, since a plurality of image sensors are arranged in the width direction Y in the line sensor 68, the line sensor 68 is capable of detecting the end portion position of the sheet without moving in the width direction Y.

FIG. 2A is a schematic diagram illustrating the puncher 61 and the die 62 positioned in home positions. The puncher 61 and the die 62 are positioned in the home positions at the start and end of an image formation job of forming an image on a sheet, and are still in the home positions also when a job is not input. The puncher 61 and the die 62 are disposed such that conveyance of the sheet is not hindered when the puncher 61 and the die 62 are in the home positions. In addition, the home position of the puncher 61 is a position upstream of an engagement position, where the puncher 61 and the die 62 engage with each other, by an angle θ in the rotation direction.

FIG. 2B is a schematic view of the puncher 61 and the die 62 at positions to which the puncher 61 has rotated from the home position and in which the puncher 61 comes into contact with the sheet, and punching of the sheet starts at these positions. That is, FIG. 2B illustrates punching starting positions of the puncher 61 and the die 62. At this time, the rotational position of the puncher 61 is a position upstream of the engagement position by an angle θ1 in the rotation direction.

FIG. 2C is a schematic view of the puncher 61 and the die 62 positioned at the engagement positions. When the puncher 61 and the die 62 are at the engagement positions, the puncher 61 engages with the die hole 64 of the die 62, and thus a hole is punched in the sheet.

FIG. 2D is a schematic view of the puncher 61 and the die 62 positioned at punching finishing positions. At these positions, the puncher 61 is separated from the sheet. The rotational position of the puncher 61 at this time is a position downstream of the engagement position by an angle θ2 in the rotation direction.

As described above, the puncher 61 and the die 62 stand by in the home positions, and start being driven by the puncher driving motor 102 at a predetermined timing on the basis of detection of the leading end of the sheet by the pre-puncher sensor 63. At this time, the puncher driving motor 102 is controlled such that the peripheral speed of the puncher 61 and the die 62 is equal to the sheet conveyance speed so as to suppress wrinkles and breakage in the sheet at the time of punching. The puncher 61 and the die 62 are separated from the punched sheet at the punching finishing positions.

Figure 3:
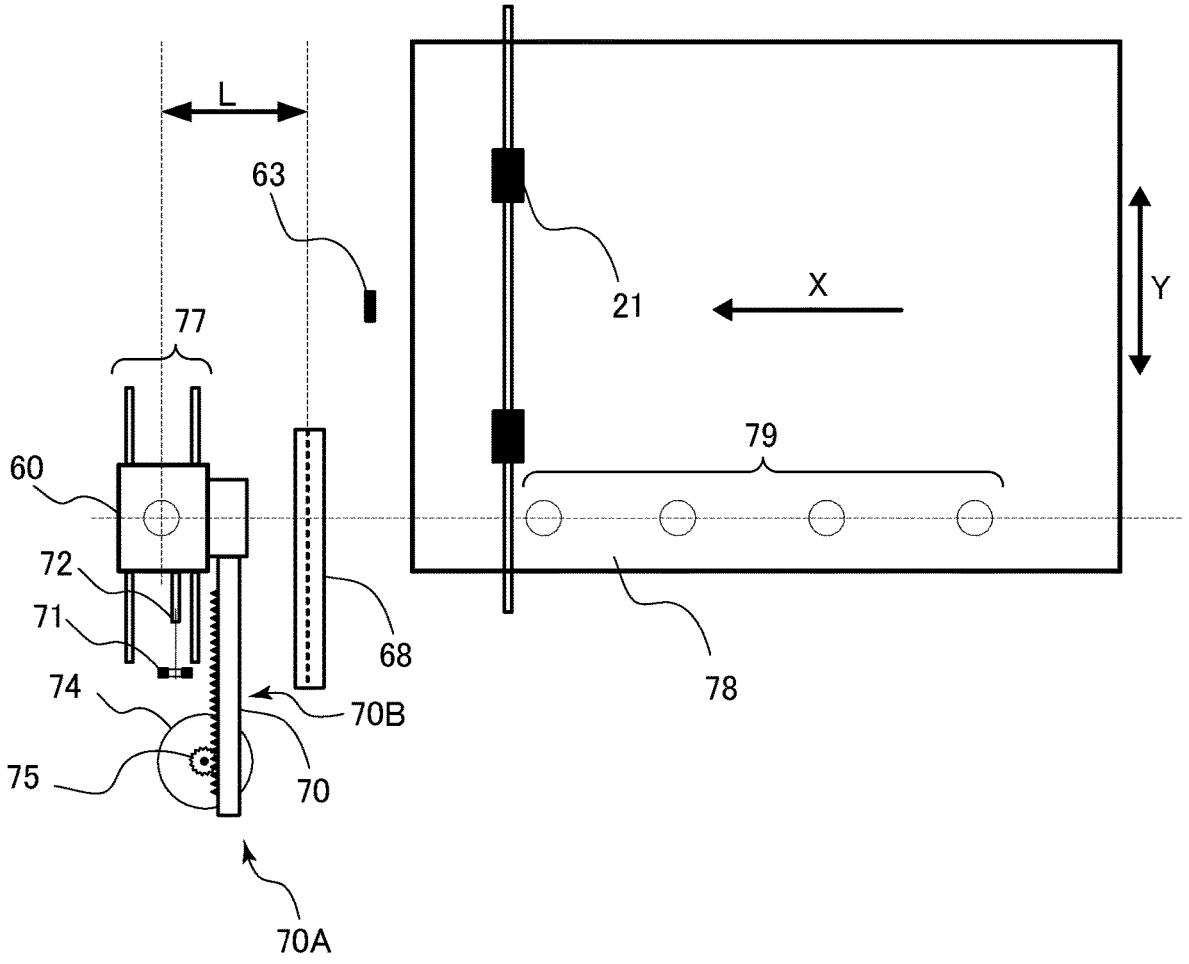
FIG. 3 is a schematic diagram illustrating a mechanism of lateral movement of a punching device according to the first embodiment.

FIG. 3 is a top view of the punching device 60, the line sensor 68, and the pre-puncher sensor 63 illustrating the layout thereof. A sheet 78 is conveyed in the conveyance direction X, that is, an arrow direction in FIG. 3, toward the punching device 60 by the inlet rollers 21. The inlet rollers 21 are rollers that are rotationally driven to convey the sheet in the conveyance direction X. The pre-puncher sensor 63 is provided at the center in the width direction Y in the conveyance path of the sheet, and detects passage of the leading end and the trailing end of the sheet in the conveyance direction X in a center portion in the width direction Y. The detection result of each image sensor of the line sensor 68 changes in accordance with the presence or absence of the sheet when the sheet passes, and thus the line sensor 68 detects the left end position of the sheet, that is, the lower end position of the sheet in FIG. 3. To be noted, the width direction Y is approximately parallel to the rotation axis direction of the inlet rollers 21.

The punching device 60 is coupled to a rack gear 70. A pinion gear 75 transmits the rotational drive of a puncher lateral movement motor 74 to the rack gear 70. A puncher moving device 70A serving as a punching member moving portion includes the puncher lateral movement motor 74 serving as a drive source and a movement mechanism 70B. In the present embodiment, the puncher lateral movement motor 74 is a stepping motor. The movement mechanism 70B has a rack-and-pinion structure including the pinion gear 75 and the rack gear 70 as described above. Further, the movement mechanism 70B is driven by the rotation of the puncher lateral movement motor 74, and laterally moves the punching device 60 in the width direction Y while being guided by a guide shaft 77.

A puncher lateral movement home position sensor: a lateral movement HP position sensor 71 is a photo interrupter constituted by a light emitting portion and a light receiving portion. A sensor flag 72 is integrally attached to the punching device 60, and moves in accordance with the lateral movement of the punching device 60. When the punching device 60 moves laterally toward the left end of the sheet, the sensor flag 72 enters the space between the light emitting portion and the light receiving portion of the puncher lateral movement home position sensor 71. In contrast, when the punching device 60 laterally moves from the left end side of the sheet toward the center, the sensor flag 72 moves out of the space between the light emitting portion and the light receiving portion of the puncher lateral movement home position sensor 71. As a result of this, the output of the puncher lateral movement home position sensor 71 changes, and the lateral movement position of the punching device 60 is specified.

The home position of the punching device 60 is set to a position to which the punching device 60 has moved outward, that is, toward the left end of the sheet, by a predetermined amount after the light in the puncher lateral movement home position sensor 71 is blocked. When the punching device 60 is in this home position, the puncher 61 does not collide with the sheet, that is, the puncher 61 is sufficiently retracted even in the case where a sheet of the maximum width that can be processed by the apparatus is conveyed.

When punching a hole in the sheet, the punching device 60 is laterally moved from the home position to a punching position. The length from the position of the left end of the sheet to the punching position in the width direction Y is determined in advance. Therefore, the punching device 60 can be moved to a desired punching position on the basis of the width, that is, the length of the sheet in the width direction Y or the position of an end portion of the sheet.

That is, when the punching device 60 is in the home position, the puncher lateral movement motor 74 starts driving in such a direction as to move the punching device 60 toward the center of the sheet. Then, the punching device 60 moves and the sensor flag 72 moves out of the space between the light emitting portion and the light receiving portion of the puncher lateral movement home position sensor 71. As a result of this, the signal of the puncher lateral movement home position sensor 71 changes, and by driving the puncher lateral movement motor 74 by a predetermined amount with this change timing as a starting point, the punching device 60 can be moved to a desired punching position corresponding to the sheet width. When the punching process on the sheet is finished, the punching device 60 is moved again to the home position.

Hardware Configuration

Figure 4:
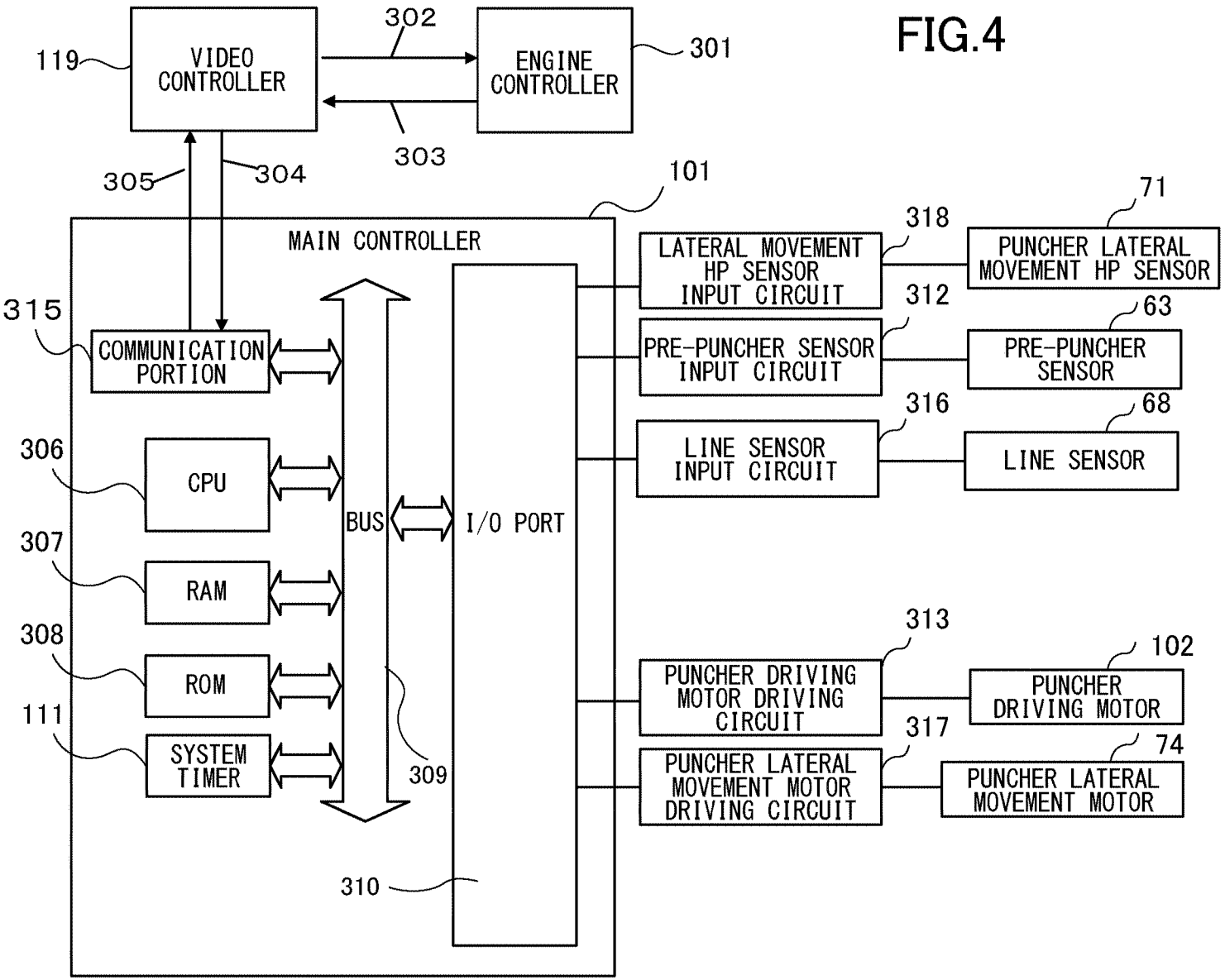
FIG. 4 is a block diagram illustrating a hardware configuration of an image forming system according to the first embodiment.

FIG. 4 is a block diagram illustrating a hardware configuration of the image forming system 1S. To be noted, in FIG. 4, elements of the sheet processing apparatus 4 related to the control of the present embodiment are mainly illustrated, and illustration of the other elements is omitted.

The image forming system 1S includes a main controller 101, a video controller 119, and an engine controller 301 as illustrated in FIG. 4, and the video controller 119 integrally controls the image forming apparatus 1 and the sheet processing apparatus 4. The engine controller 301 controls the image forming apparatus 1, and the main controller 101 controls the sheet processing apparatus 4.

The video controller 119 is connected to the engine controller 301 and the main controller 101 respectively via serial command transmission signal lines 302 and 304, and transmits commands to the engine controller 301 and the main controller 101 by serial communication. The engine controller 301 is connected to the video controller 119 via a serial status transmission signal line 303, and transmits status data to the video controller 119 by serial communication. The main controller 101 serving as a controller is connected to the video controller 119 via a serial status transmission signal line 305, and transmits status data to the video controller 119 by serial communication.

When performing an image forming operation, the video controller 119 performs control by transmitting serial commands to the engine controller 301 and the main controller 101 and receiving status data from the engine controller 301 and the main controller 101. As described above, when a plurality of apparatuses are connected to each other and operated, the video controller 119 integrally manages the status and control of each apparatus to maintain cohesion between operations of the apparatuses.

The main controller 101 includes a central processing unit: CPU 306, a random-access memory: RAM 307, a read-only memory: ROM 308, a system timer 111, a communication portion 315, an input/output port: I/O port 310, and so forth. The CPU 306 is a central processing unit that controls various operations of the sheet processing apparatus 4. The RAM 307 is a volatile memory that temporarily stores control data required for operation of the sheet processing apparatus 4. The ROM 308 is a nonvolatile memory that stores a program and a control table required for operation of the sheet processing apparatus 4.

The system timer 111 generates a timing required for various control, and the communication portion 315 performs communication with the video controller 119. These CPU 306, RAM 307, ROM 308, system timer 111, and communication portion 315 are connected to the I/O port 310 via a bus 309, and the I/O port 310 outputs and inputs control signals to and from various units of the sheet processing apparatus 4. More specifically, the I/O port 310 is connected to the puncher lateral movement HP sensor 71 via a lateral movement HP sensor input circuit 318. In addition, the I/O port 310 is connected to the line sensor 68 and the pre-puncher sensor 63 respectively via a line sensor input circuit 316 and a pre-puncher sensor input circuit 312. Further, the I/O port 310 is connected to the puncher driving motor 102 and the puncher lateral movement motor 74 respectively via a puncher driving motor driving circuit 313 and a puncher lateral movement motor driving circuit 317.

Functional Configuration

Figure 5:
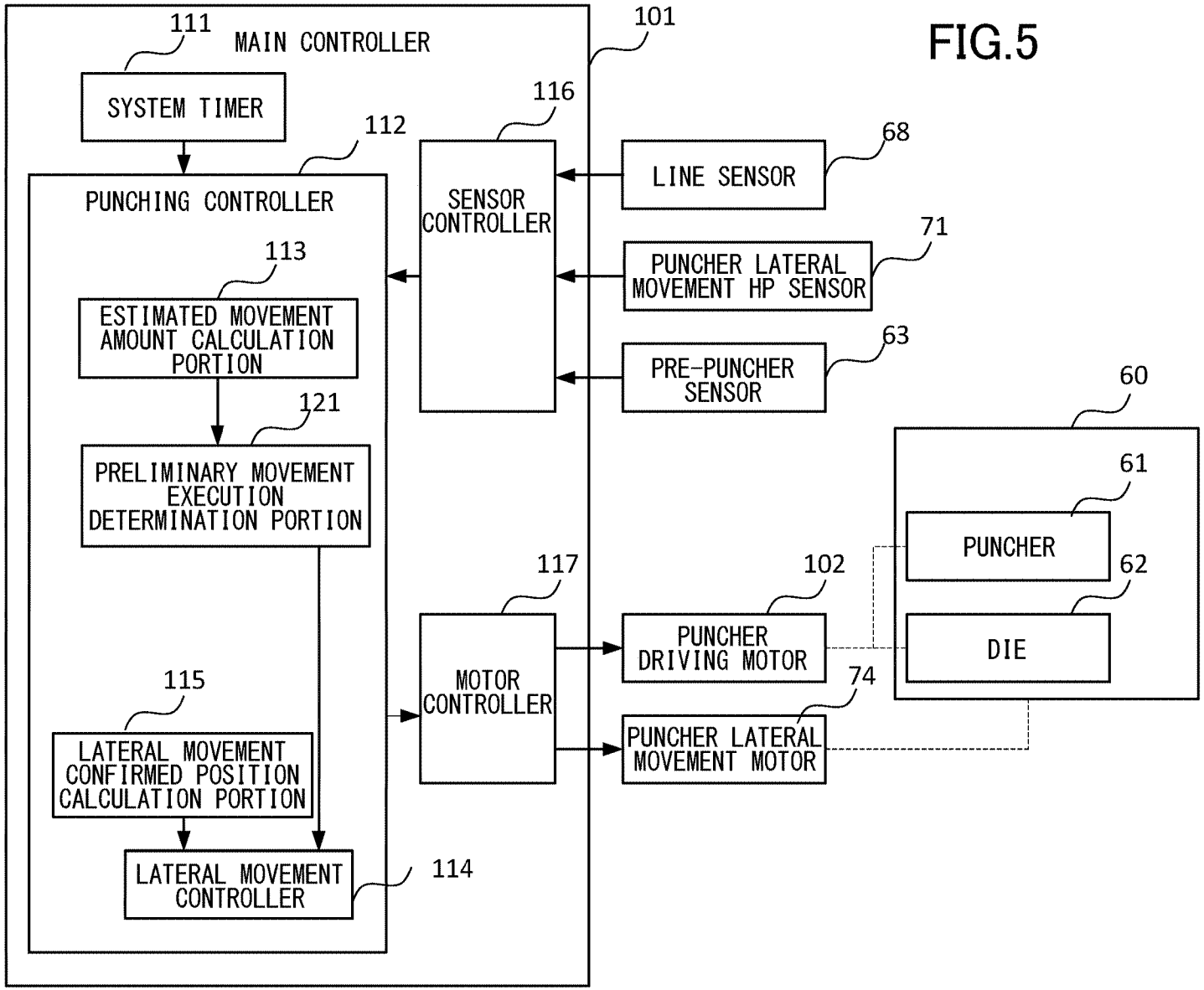
FIG. 5 is a block diagram illustrating a functional configuration of the image forming system according to the first embodiment.

FIG. 5 is a block diagram illustrating a functional configuration of the image forming system 1S. To be noted, in FIG. 5, mainly parts related to punching control on the sheet of the present embodiment are extracted and illustrated, and illustration of the other parts is omitted.

The main controller 101 includes the system timer 111, a punching controller 112, a sensor controller 116, and a motor controller 117 as illustrated in FIG. 5, and controls conveyance of and punching on the sheet in the image forming system 1S. Signals from the line sensor 68, the pre-puncher sensor 63, and the puncher lateral movement HP sensor 71 are input to the sensor controller 116. Then, the sensor controller 116 outputs information about the presence or absence of a sheet at each sensor and information about the end portion position of the sheet to the punching controller 112. The punching controller 112 drives the puncher driving motor 102 driving the puncher 61 and the die 62 and the puncher lateral movement motor 74 driving the punching device 60 by controlling the motor controller 117.

The punching controller 112 includes an estimated movement amount calculation portion 113, a preliminary movement execution determination portion 121, a lateral movement confirmed position calculation portion 115, and a lateral movement controller 114. The punching controller 112 detects passage of the leading end of the sheet through the position of the pre-puncher sensor 63 from a signal change of the pre-puncher sensor 63 received via the sensor controller 116. The end portion position of a succeeding sheet in the width direction Y that coincides, in the conveyance direction X, with the leading end thereof in the conveyance direction X is detected by the line sensor 68 on the basis of this detection timing. In the present embodiment, the end portion position is the position of a left end of the sheet. Hereinafter, an end portion position of a sheet in the width direction Y that coincides with a certain position in the conveyance direction X will be referred to as an end portion position of the sheet in the width direction Y at the certain position.

The estimated movement amount calculation portion 113 estimates and calculates a lateral movement amount, which is the distance between the final punching position of a preceding sheet and the first punching position of a succeeding sheet in the width direction Y, from the detection result of the line sensor 68. The final punching position of the preceding sheet is a current lateral movement position of the puncher, and the puncher is laterally moved by the estimated lateral movement amount before the start of punching on the succeeding sheet. The preliminary movement execution determination portion 121 determines whether or not to execute the lateral movement of the puncher on the basis of the estimated value of the lateral movement amount calculated by the estimated movement amount calculation portion 113.

The lateral movement confirmed position calculation portion 115 determines, on the basis of the timing at which the leading end of the sheet has passed the pre-puncher sensor 63, the timing at which the left end of the sheet at the punching position has reached the position of the line sensor 68. Then, by detecting the left end position of the sheet at this timing by the line sensor 68, the lateral movement confirmed position of the puncher is finally calculated.

The lateral movement controller 114 controls the timing at which the lateral movement of the puncher is started and transmits a drive instruction to the puncher lateral movement motor 74 through the motor controller 117, after the lateral movement amount is calculated by the estimated movement amount calculation portion 113 or the lateral movement confirmed position calculation portion 115.

Deviation Between Preceding Sheet and Succeeding Sheet in Width Direction

Next, among successively conveyed sheets, a sheet that is conveyed first will be referred to as a preceding sheet 200, a sheet conveyed subsequently to the preceding sheet 200 will be referred to as a succeeding sheet 201 with reference to FIG. 6, and the punching process in the case where these sheets are conveyed in a state of being displaced with each other in the width direction Y will be described.

The conveyance of the sheet can differ due to various factors such as the configuration of the conveyance path in the sheet processing apparatus, the state of the sheet, and whether the conveyance rollers are brand-new or used, and successively conveyed sheets can be conveyed in a state of being laterally shifted as described above. The maximum amount of displacement between the sheets when all these conditions lean toward varying the conveyance of sheets is determined for each apparatus. In the present embodiment, this displacement amount will be referred to as a maximum displacement amount 205 as illustrated in FIG. 6.

Figure 6:
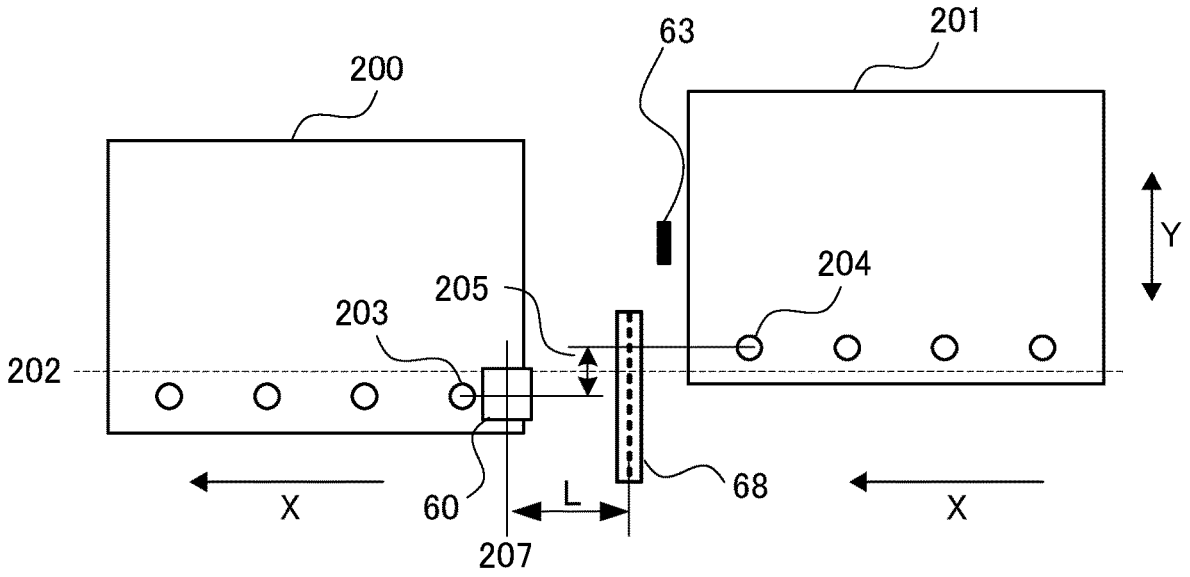
FIG. 6 is a schematic diagram illustrating a state in which a preceding sheet and a succeeding sheet are conveyed in a state of being displaced from each other in the lateral direction.

The preceding sheet 200 and the succeeding sheet 201 are successively conveyed from the right to the left in the conveyance direction X in FIG. 6 as indicated by an arrow in FIG. 6. A dot line 202 indicates a punching position in the width direction Y in the case where the sheets are conveyed in an ideal state in which there is no displacement. This punching position will be also referred to as an ideal position. FIG. 6 illustrates a case where the preceding sheet 200 is conveyed in a manner displaced to the most left in the width direction Y, that is, to the lowermost position from the ideal position in FIG. 6, whereas the succeeding sheet 201 is conveyed in a manner displaced to the most right in the width direction Y, that is, to the uppermost position from the ideal position in FIG. 6. Therefore, the distance between a punching position 203 of the preceding sheet 200 and a punching position 204 of the succeeding sheet 201 in the width direction Y is equal to the maximum displacement amount 205. To be noted, in the description below, the "left" and the "right" in the width direction Y are directions in the case of viewing the sheet from above and in the conveyance direction X.

The puncher 61 of the punching device 60 illustrated in FIG. 2A and so forth has to perform punching at the punching position 203 of the preceding sheet 200, then laterally move to the right in the width direction Y by the maximum displacement amount 205, and perform punching at the first punching position 204 of the succeeding sheet 201. The first punching position is a punching position that is the most downstream in the conveyance direction X among a plurality of punching positions of the succeeding sheet 201. Here, the punching position 204 of the succeeding sheet 201 can be determined when the left end of the succeeding sheet 201 at the punching position 204 is detected by the line sensor 68. That is, the position of the punching position 204 is determined when the end portion position of the succeeding sheet 201 in the width direction Y at the punching position 204 is detected by the line sensor 68.

Therefore, the lateral movement of the puncher 61 needs to be completed while the sheet is conveyed by a distance from the position of the line sensor 68 to a predetermined position 207 where a hole is punched in the punching position 204 of the succeeding sheet 201 by the puncher 61 of the punching device 60. The distance from the line sensor 68 to the predetermined position 207 is just L indicated in FIG. 2. If this distance L is set to a large value, the apparatus becomes larger and the cost becomes higher. In addition, there is a problem that, if the left end position of the sheet detected by the line sensor 68 is displaced while the sheet is conveyed to the predetermined position 207, the error of the punching position becomes large. Therefore, the distance L is preferably set to be small by disposing the line sensor 68 near the predetermined position 207.

The puncher lateral movement motor 74 serving as a drive source for lateral movement of the punching device 60 is preferably a stepping motor suitable for position control. Therefore, in the present embodiment, a stepping motor is used as the puncher lateral movement motor 74. The stepping motor has restrictions in the torque that can be output, the number of rotations that can be output, and so forth. The punching device 60 is a unit constituted by heavy parts, and the motor cannot be driven at a speed equal to or higher than a predetermined speed for moving this heavy unit. Therefore, the punching device 60 is configured to be laterally moved at a predetermined speed. This speed will be referred to as a lateral movement speed.

Time required for the punching device 60 to laterally move by the maximum displacement amount 205 is determined in advance in accordance with the maximum displacement amount 205 and the lateral movement speed. The rotary puncher 61 starts punching at the position upstream of the engagement position by the angle θ1 in the rotation direction as illustrated in FIG. 2B. Therefore, the lateral movement of the punching device 60 needs to be completed before the puncher 61 reaches the position upstream of the engagement position by the angle θ1 in the rotation direction.

As described above, the time that can be used for lateral movement of the punching device 60 is obtained by subtracting the time in which the puncher 61 rotates by the angle θ1 from the time in which the sheet is conveyed by the distance L. This time will be referred to as a time T1. That is, the time T1 is a time from a time point when the end portion position, that is, the left end position of the succeeding sheet 201 in the width direction Y at the punching position 204 is detected by the line sensor 68 to the start of the punching process on the punching position 204 of the succeeding sheet 201. The distance by which the punching device 60 can be laterally moved in the time T1 will be referred to as a maximum movement amount of the punching device 60. In the case where the maximum movement amount is smaller than the maximum displacement amount 205, the lateral movement of the punching device 60 is not completed before the punching timing if the lateral movement of the puncher is started after detecting the left end of the succeeding sheet 201 at the punching position 204 by the line sensor 68.

Therefore, in the present embodiment, the main controller 101 enables execution of preliminary movement for performing the punching process on the succeeding sheet 201. The preliminary movement is an operation of starting the movement of the puncher 61 of the punching device 60 in the width direction Y after finishing the punching process on the preceding sheet 200 and before the end portion position, that is, the left end position of the succeeding sheet 201 in the width direction Y at the first punching position 204 reaches the line sensor 68. Specifically, the first punching position 204 of the succeeding sheet 201 is estimated before the left end position of the succeeding sheet 201 at the punching position 204 is detected by the line sensor 68, that is, before the position of the first punching position 204 of the succeeding sheet 201 is confirmed. Then, the lateral movement of the puncher toward the estimated punching position is started.

Therefore, in the preliminary movement, the movement of the punching device 60 is started at the timing at which the end portion position of the succeeding sheet 201 in the width direction Y at any position within a range from the leading end of the succeeding sheet 201 in the conveyance direction X to the first punching position 204 of the succeeding sheet reaches the line sensor 68. In the present embodiment, the first punching position 204 of the succeeding sheet 201 is estimated by measuring the end portion position of the succeeding sheet 201 in the width direction Y at the leading end of the succeeding sheet 201 in the conveyance direction X by the line sensor 68. In other words, the first punching position 204 of the succeeding sheet 201 is estimated from the end portion position of the succeeding sheet 201 in the width direction Y at the leading end of the succeeding sheet 201 in the conveyance direction X detected by the line sensor 68. Then, the movement of the punching device 60 is started approximately at the same timing as the timing at which the end portion position of the succeeding sheet 201 in the width direction Y at the leading end thereof in the conveyance direction X reaches the line sensor 68.

Preliminary Movement of Punching Device

The preliminary movement in which the first punching position 204 of the succeeding sheet 201 is estimated and the lateral movement of the puncher is started on the basis of the estimated position will be described below with reference to FIGS. 7A to 7E. FIGS. 7A to 7E are diagrams sequentially illustrating the movement from punching on the preceding sheet 200 to punching on the succeeding sheet 201 in time series in the case where the preceding sheet 200 and the succeeding sheet 201 are conveyed in a state of being shifted from each other by the maximum displacement amount 205. To be noted, the leading end of a sheet mentioned in the description below is the leading end of the sheet in the conveyance direction, that is, the downstream end of the sheet in the conveyance direction.

Figure 7A:
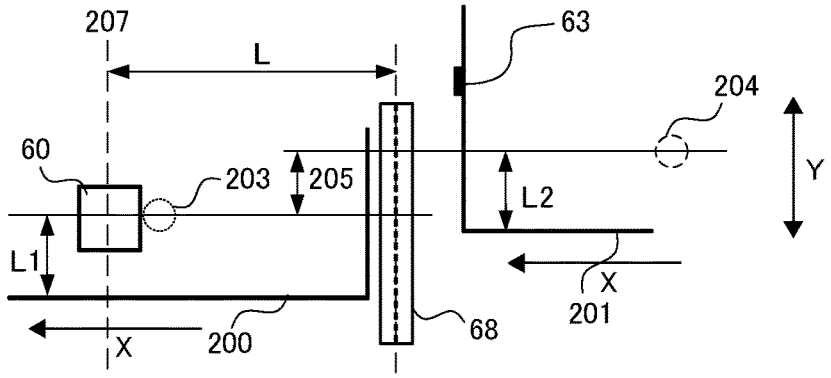
FIG. 7A is a first schematic diagram illustrating a motion of the punching device in the first embodiment in the case where the distance between punching positions of the preceding sheet and the succeeding sheet in the lateral direction is small.

FIG. 7A illustrates a moment when the leading end of the succeeding sheet 201 is detected by the pre-puncher sensor 63. The timing when the leading end position or the punching position 204 of the succeeding sheet 201 reaches the line sensor 68 is detected with this timing as a starting point.

Figure 7B:
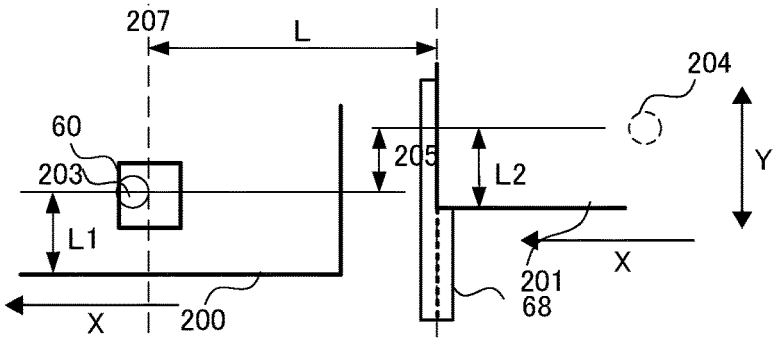
FIG. 7B is a second schematic diagram illustrating the motion of the punching device in the first embodiment in the case where the distance between the punching positions of the preceding sheet and the succeeding sheet in the lateral direction is small.

FIG. 7B illustrates a moment when the left end position of the leading end of the succeeding sheet 201 is detected by the line sensor 68. At this time, the punching device 60 is at a position in a distance L1 from the left end of the preceding sheet 200 toward the center of the sheet. This is because the left end position of the preceding sheet 200 at the punching position 203 is measured by the line sensor 68 and the punching device 60 is moved such that the distance between the punching device 60 and the left end of the preceding sheet 200 becomes L1. The distance L1 is determined as a standard.

In addition, at this time, the left end position of the leading end of the succeeding sheet 201 is detected by the line sensor 68, and the position of the punching position 204 of the succeeding sheet 201 is estimated on the basis of this result. The estimated position is in a distance L2 from the left end position of the leading end of the succeeding sheet 201 toward the center of the sheet. The distance L2 is equal to the distance L1. The estimated lateral movement amount of the punching device 60 is calculated on the basis of this estimated value. This calculation is performed by the estimated movement amount calculation portion 113 illustrated in FIG. 4. In the example of FIGS. 7A to 7E, the estimated movement amount is used as the maximum displacement amount 205.

Figure 7C:
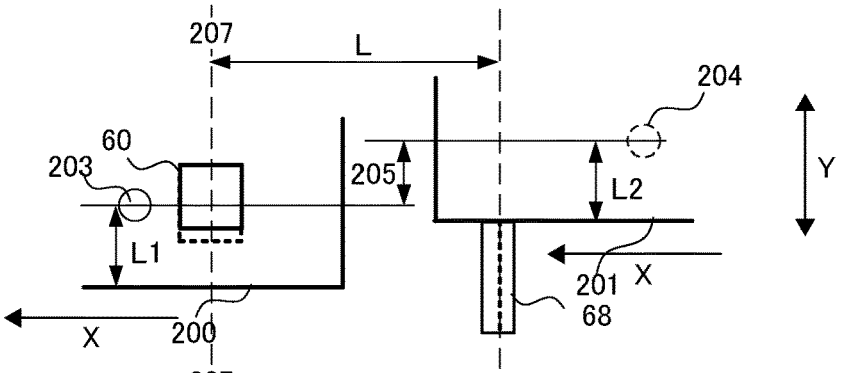
FIG. 7C is a third schematic diagram illustrating the motion of the punching device in the first embodiment in the case where the distance between the punching positions of the preceding sheet and the succeeding sheet in the lateral direction is small.

FIG. 7C illustrates a time when the punching device 60 starts the preliminary movement toward the estimated punching position of the succeeding sheet 201. The determination regarding the execution of the preliminary movement is made by the preliminary movement execution determination portion 121 illustrated in FIG. 4. The preliminary movement execution determination portion 121 determines whether or not to execute the preliminary movement in the case where the estimated movement amount is larger than an execution determination threshold value of the preliminary movement serving as a predetermined threshold value.

The execution determination threshold value serving as a predetermined threshold value is a value equal to or larger than the maximum movement amount by which the puncher 61 of the punching device 60 can be moved by the puncher moving device 70A illustrated in FIG. 3 in the time T1. To be noted, the execution determination threshold value is equal to or less than a half or equal to or less than a third of the length of the sheet in the width direction. The time T1 is a time from a time point when the end portion position, that is, the left end position of the succeeding sheet 201 in the width direction Y at the punching position 204 is detected by the line sensor 68 to the start of the punching process at the punching position 204 of the succeeding sheet 201 as described above. In the present embodiment, an amount obtained by adding a margin to the maximum movement amount of the punching device 60 is employed as the execution determination threshold value of the preliminary movement. That is, a value larger than the maximum movement amount of the punching device 60 is used as the execution determination threshold value.

In the present embodiment, the preliminary movement is performed in the case where the preliminary movement amount is larger than the execution determination threshold value as described above. However, such a threshold value does not have to be set. For example, a configuration in which the preliminary movement is necessarily executed even in the case where the estimated movement amount is small may be employed.

In addition, at the time of the preliminary movement, an upper limit of the preliminary movement amount serving as a predetermined upper limit value is determined in advance. The preliminary movement amount is an amount by which the punching device 60 actually moves in the width direction Y when the preliminary movement is executed. In the present embodiment, a value equal to the estimated movement amount is set as the upper limit of the preliminary movement amount. That is, the preliminary movement is stopped in the case where the movement amount in the preliminary movement has reached the predetermined upper limit value before the punching position of the succeeding sheet 201 is confirmed after the start of the preliminary movement. In addition, in the case where the punching position of the succeeding sheet 201 is confirmed during the preliminary movement before the movement amount reaches the upper limit, confirmed movement is performed without continuing the preliminary movement to the upper limit. The estimated movement amount from the position of the puncher 61 of the punching device 60 at the end of the punching process on the preceding sheet 200 to the estimated punching position is used as this predetermined upper limit value. To be noted, the predetermined upper limit value may be a constant value not dependent on the estimated movement amount.

Figure 7D:
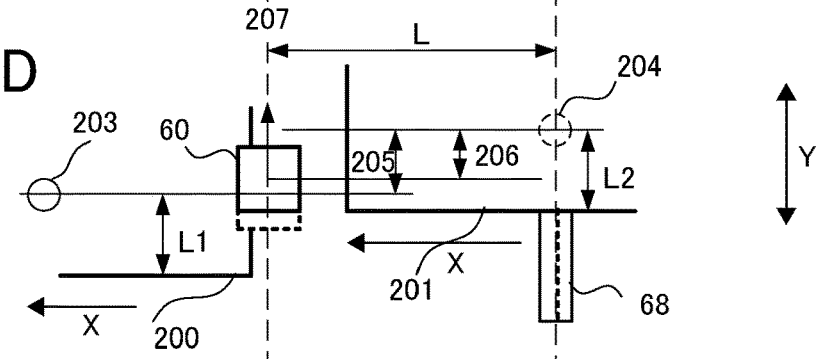
FIG. 7D is a fourth schematic diagram illustrating the motion of the punching device in the first embodiment in the case where the distance between the punching positions of the preceding sheet and the succeeding sheet in the lateral direction is small.

FIG. 7D illustrates a timing when the left end position of the succeeding sheet 201 at the punching position 204 is detected by the line sensor 68. As a result of this, the final position of the punching position 204 is confirmed. At this timing, the punching device 60 is already in the middle of the preliminary movement. The target position of the lateral movement is updated from the estimated position to the confirmed position.

That is, the main controller 101 confirms the punching position of the succeeding sheet 201 in the case where the end portion position of the succeeding sheet 201 in the width direction Y at the punching position 204 is detected by the line sensor 68 during the preliminary movement. Then, the main controller 101 moves the punching device 60 to the confirmed punching position 204 regardless of the estimated punching position. This confirmed position is a position obtained by finely adjusting the estimated position. The lateral movement can be completed before the punching process on the succeeding sheet 201 if the punching device 60 can be moved from the current position by a distance 206 to the confirmed punching position 204.

Figure 7E:
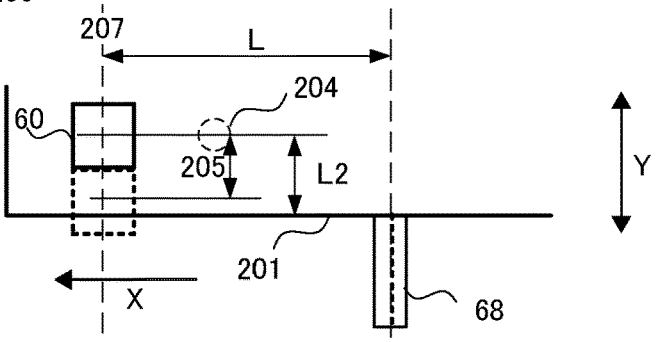
FIG. 7E is a fifth schematic diagram illustrating the motion of the punching device in the first embodiment in the case where the distance between the punching positions of the preceding sheet and the succeeding sheet in the lateral direction is small.

FIG. 7E illustrates a state in which the punching device 60 has laterally moved to the confirmed punching position 204 of the succeeding sheet 201 and the succeeding sheet 201 is yet to be punched.

In the present embodiment, the left end position of the leading end of the succeeding sheet 201 is measured by the line sensor 68, and then the preliminary movement of the punching device 60 is started. Therefore, the lateral movement amount of the punching device 60 required while conveying the succeeding sheet 201 by the distance L can be set to the distance 206 smaller than the maximum displacement amount 205 by the amount of the preliminary movement. If the lateral movement amount is the distance 206, the lateral movement of the punching device 60 to the punching position 204 of the succeeding sheet 201 can be completed.

Control of Punching Process

Figure 8:
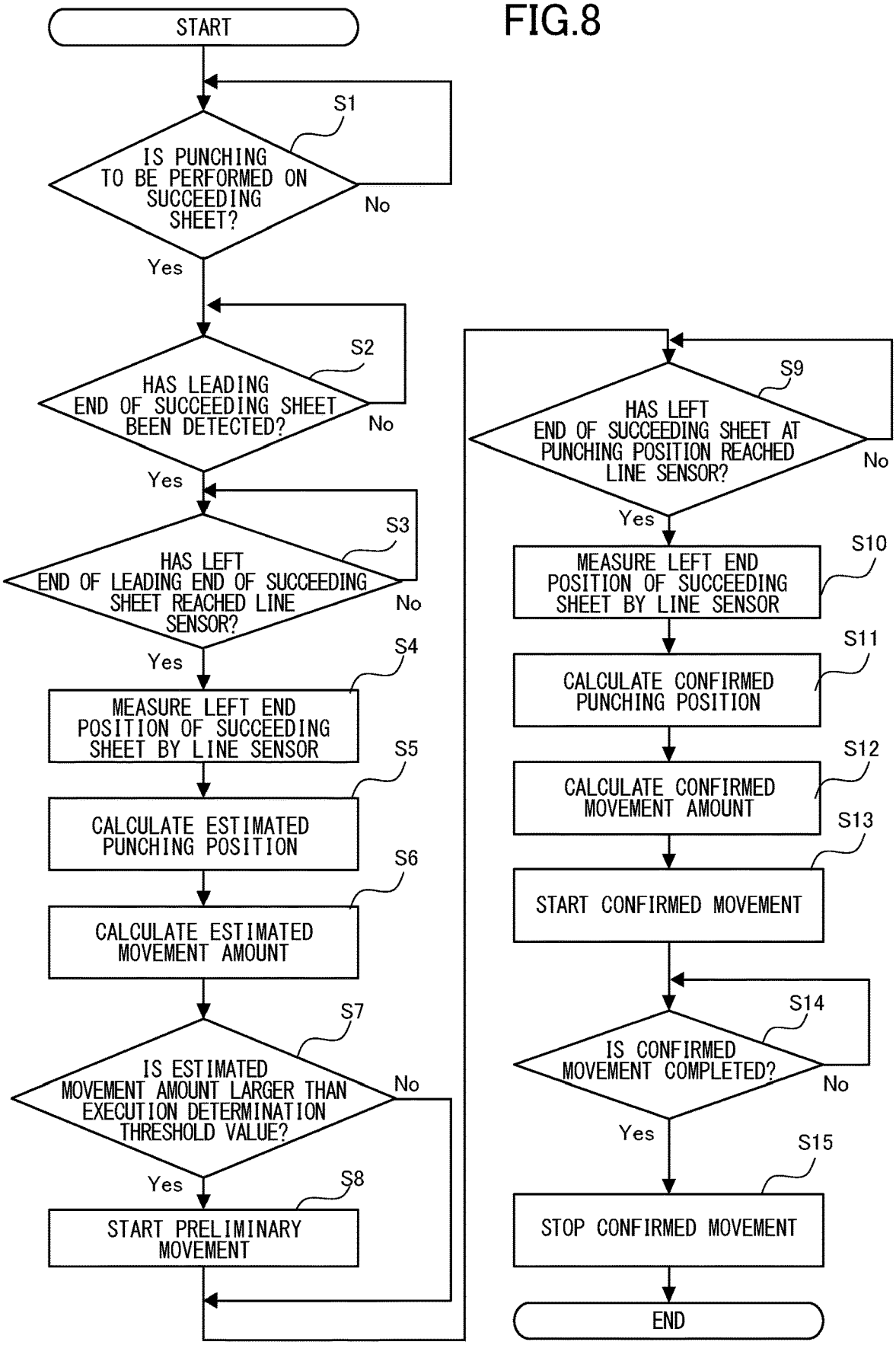
FIG. 8 is a flowchart illustrating control of a punching process according to the first embodiment.

The operation of the preceding sheet 200 and the succeeding sheet 201 has been described above in time series with reference to FIGS. 7A to 7E. Next, a control method for this operation will be described with reference to a flowchart of FIG. 8. FIG. 8 is a flowchart illustrating control by the main controller 101 in FIG. 5. In FIG. 8, in step S1, the main controller 101 waits for information about whether to perform the punching process on the succeeding sheet 201. This is performed on the basis of a result of communication of the main controller 101 with the video controller 119 illustrated in FIG. 4 via the communication portion 315. That is, the main controller 101 makes the determination by detecting whether or not an instruction for a print job from an external device such as a personal computer or an instruction for printing or copying input by a user operation on an unillustrated operation panel has been received by the main controller 101 via the communication portion 315.

Then, in the case where the succeeding sheet 201 is to be punched, in step S2, the estimated movement amount calculation portion 113 in the main controller 101 monitors a signal from the pre-puncher sensor 63 via the sensor controller 116, and waits for the leading end of the succeeding sheet 201 to be detected by the pre-puncher sensor 63. In step S3, with the timing at which the leading end of the succeeding sheet 201 is detected by the pre-puncher sensor 63 as the starting point, the main controller 101 waits for the left end of the leading end of the succeeding sheet 201 to reach the line sensor 68. Then, in step S4, the left end position of the leading end of the succeeding sheet 201 is measured by the line sensor 68. In step S5, the estimated punching position of the succeeding sheet 201 is calculated from the measurement result of the line sensor 68. In step S6, the estimated movement amount, which is the lateral movement amount from the current position of the punching device 60 to the estimated punching position of the succeeding sheet 201, is calculated.

In step S7, whether or not the calculated estimated lateral movement amount is larger than the execution determination threshold value of the preliminary movement is determined. In the present embodiment, in the case where the estimated lateral movement amount is equal to or smaller than the execution determination threshold value of the preliminary movement, that is, in the case where the result of step S7 is No, the preliminary movement is not performed. The execution determination threshold value is set as a value smaller than the movement amount by which the punching device 60 can laterally move in a time after the left end position of the succeeding sheet 201 at the punching position 204 is detected by the line sensor 68 and before the punching position 204 of the succeeding sheet 201 is conveyed to a predetermined position at which the punching process is performed.

In the case where the estimated movement amount is smaller than the execution determination threshold value, the lateral movement of the punching device 60 can be completed before the punching process on the succeeding sheet 201 even if the lateral movement is started after the left end position of the succeeding sheet 201 at the punching position 204 is detected by the line sensor 68. According to such a configuration, the lateral movement does not have to be executed twice for the preliminary movement and the confirmed movement to the confirmed punching position of the succeeding sheet 201. A configuration like the present embodiment may be employed in the case where noise of motor caused by increase in the number of times of the lateral movement is problematic. However, if there is no problem concerning the noise or the like, a configuration in which a threshold value for execution determination is not provided and the preliminary movement is necessarily performed regardless of the value of the estimated movement amount may be employed.

In the case where the estimated movement amount is larger than the execution determination threshold value, that is, in the case where the result of step S7 is Yes, the preliminary movement of the punching device 60 is started in step S8. After the start of the preliminary movement, the punching position 204 of the succeeding sheet 201 is confirmed, and processing of calculating the movement amount of confirmed movement is performed. In step S9, the lateral movement confirmed position calculation portion 115 in the main controller 101 waits for the left end position of the succeeding sheet 201 at the punching position 204 to reach the line sensor 68 with the timing at which the leading end of the succeeding sheet 201 is detected by the pre-puncher sensor 63 as a starting point. Then, in step S10, the left end position of the succeeding sheet 201 is measured by the line sensor 68 when the left end position of the succeeding sheet 201 at the punching position 204 reaches the line sensor 68.

In step S11, the confirmed punching position of the succeeding sheet 201 is calculated from the measurement result of the line sensor 68. In step S12, confirmed movement amount, which is the lateral movement amount from the current position of the punching device 60 to the confirmed punching position of the succeeding sheet 201, is calculated. Then, in step S13, the movement to the confirmed position, that is, the confirmed movement is started. The completion of the confirmed movement is waited for in step S14, and the confirmed movement is stopped in step S15 when the confirmed movement is completed.

Upper Limit of Preliminary Movement

In the present embodiment, an upper limit is set for the movement amount in the preliminary movement as described above, and this upper limit is set to a value equal to the estimated movement amount. In the case where the punching position 204 of the succeeding sheet 201 is confirmed during the preliminary movement before the movement amount reaches the upper limit, the confirmed movement is performed without continuing the preliminary movement to the upper limit. FIGS. 7A to 7E illustrate this example, that is, the motion of the punching device 60 in the case where the distance between the punching positions of the preceding sheet 200 and the succeeding sheet 201 in the lateral direction is small.

In contrast, in the case where the punching position 204 of the succeeding sheet 201 is not confirmed even when the movement amount of the preliminary movement has reached the upper limit, the preliminary movement is stopped, and the confirmed movement is started after waiting for the punching position 204 of the succeeding sheet 201 to be confirmed. That is, the main controller 101 stops the preliminary movement in the case where the movement amount of the preliminary movement has reached a predetermined upper limit value after the preliminary movement is started and before the punching position 204 of the succeeding sheet 201 is confirmed. The motion of the punching device 60 in this example, that is, the motion of the punching device 60 in the case where the distance between the punching positions of the preceding sheet 200 and the succeeding sheet 201 in the lateral direction is large will be described with reference to FIGS. 9A to 9E. In FIGS. 9A to 9E, the same elements as in FIGS. 7A to 7E will be denoted by the same reference numerals and description thereof will be omitted.

Figure 9A:
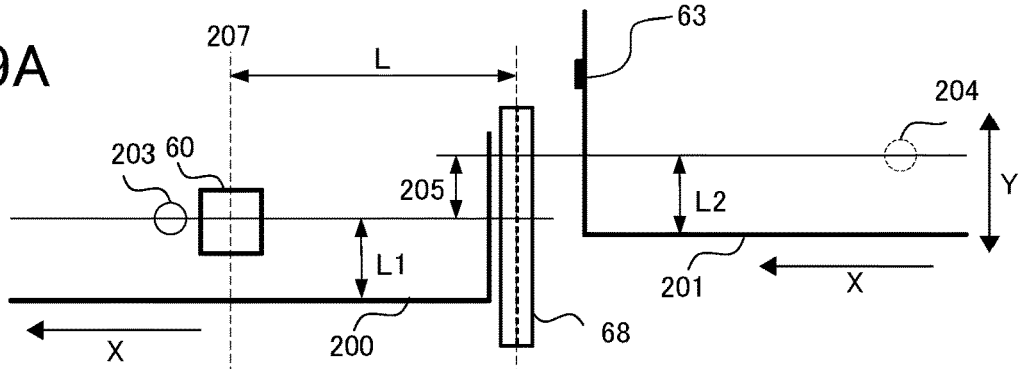
FIG. 9A is a first schematic diagram illustrating a motion of the punching device in the first embodiment in the case where the distance between the punching positions of the preceding sheet and the succeeding sheet in the lateral direction is large.
Figure 9B:
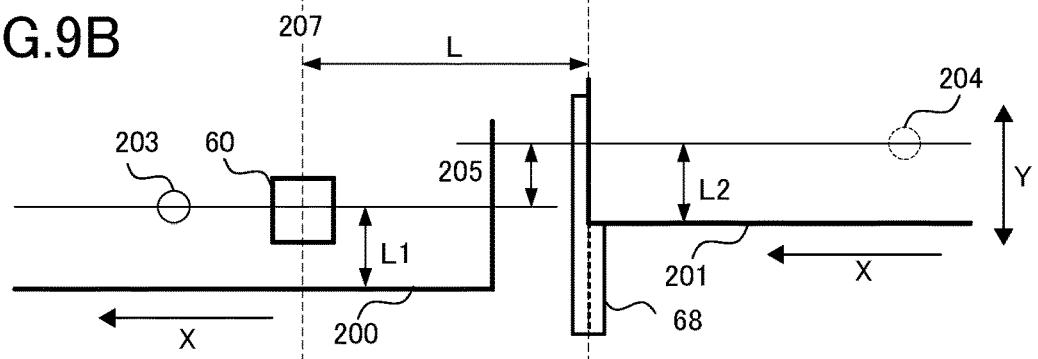
FIG. 9B is a second schematic diagram illustrating the motion of the punching device in the first embodiment in the case where the distance between the punching positions of the preceding sheet and the succeeding sheet in the lateral direction is large.
Figure 9C:
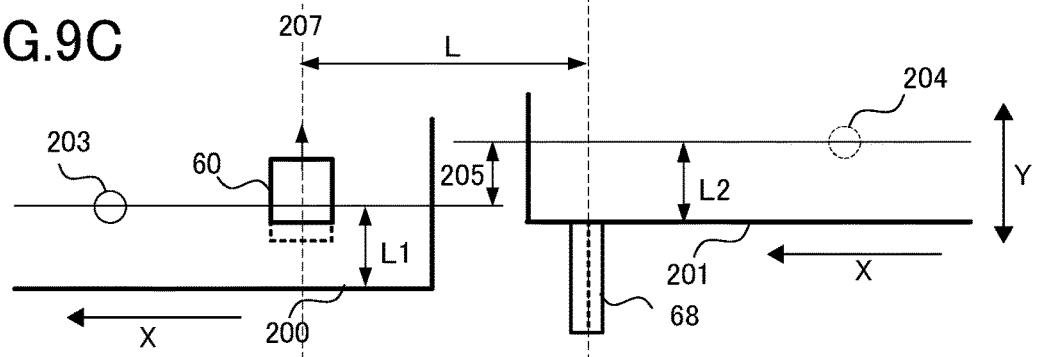
FIG. 9C is a third schematic diagram illustrating the motion of the punching device in the first embodiment in the case where the distance between the punching positions of the preceding sheet and the succeeding sheet in the lateral direction is large.

FIG. 9A illustrates a moment when the leading end of the succeeding sheet 201 is detected by the pre-puncher sensor 63. FIG. 9B illustrates a moment when the left end position of the leading end of the succeeding sheet 201 is detected by the line sensor 68. FIG. 9C illustrates a state in the middle of the preliminary movement of the punching device 60.

Figure 9D:
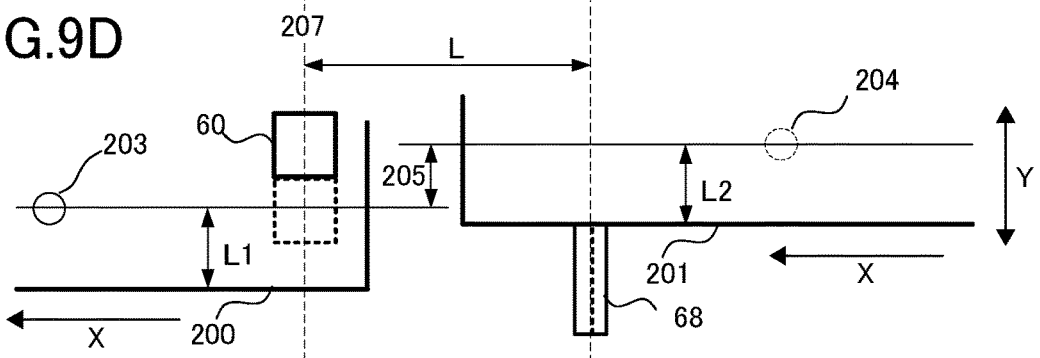
FIG. 9D is a fourth schematic diagram illustrating the motion of the punching device in the first embodiment in the case where the distance between the punching positions of the preceding sheet and the succeeding sheet in the lateral direction is large.

FIG. 9D illustrates a state in which the preliminary movement amount of the punching device 60 has reached the upper limit serving as a predetermined upper limit value and the lateral movement of the punching device 60 has been stopped. The upper limit is equal to the estimated movement amount. At this time, the left end position of the succeeding sheet 201 at the punching position 204 has not been detected by the line sensor 68 yet. The lateral position of the punching device 60 is maintained at this position.

Figure 9E:
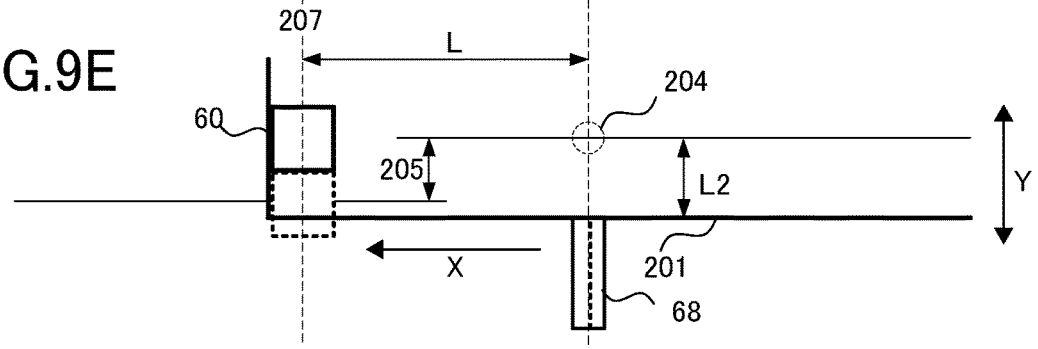
FIG. 9E is a fifth schematic diagram illustrating the motion of the punching device in the first embodiment in the case where the distance between the punching positions of the preceding sheet and the succeeding sheet in the lateral direction is large.

FIG. 9E illustrates a timing when the left end position of the succeeding sheet 201 at the punching position 204 is detected by the line sensor 68. At this timing, the position of the punching position 204 of the succeeding sheet 201 is confirmed, and the confirmed movement of the punching device 60 is started. Since the difference between the estimated punching position and the confirmed punching position is sufficiently smaller than the distance by which the punching device 60 can be laterally moved in the time in which the sheet is conveyed by the distance L, the confirmed movement is completed without a problem.

As described above, in the present embodiment, the left end position of the leading end of the succeeding sheet 201 is detected by the line sensor 68, thus the punching position 204 of the succeeding sheet 201 is estimated, and the preliminary movement of the punching device 60 is started on the basis of the estimated value. As a result of this, the lateral movement of the punching device 60 between sheets can be completed even in the case where sheets displaced from each other by the maximum displacement amount are successively conveyed, and thus the punching can be performed with high accuracy. Therefore, the movement of the punching device can be completed even in the case where distance L between the line sensor and the predetermined position at which the punching is to be performed by the punching device is smaller than in the case where the movement of the punching device is started after detecting the end portion position of the succeeding sheet at a punching position by the line sensor. If the distance L can be reduced as described above, the productivity can be improved. That is, according to the present embodiment, the productivity can be improved in the case where a punching process is performed on sheets that are successively conveyed.

In addition, increase in the size of the apparatus can be avoided because the distance L between the line sensor 68 and a punching position can be reduced. Further, since the puncher lateral movement motor 74 serving as a drive source of the punching device 60 does not have to be driven at high speed, an expensive motor does not have to be used as this motor, and thus the cost can be reduced.

Second Embodiment

A second embodiment will be described with reference to FIGS. 10 and 11. In the first embodiment described above, a value equal to the estimated movement amount is set as the upper limit of the preliminary movement amount. Therefore, a special value does not have to be calculated as the upper limit of the preliminary movement amount. In contrast, in the present embodiment, the upper limit of the preliminary movement amount serving as a predetermined upper limit value can be set to an arbitrary value. The arbitrary value is not necessarily equal to the preliminary movement amount, and an appropriate amount is calculated for each apparatus. The other elements and effects are substantially the same as those of the first embodiment described above. Therefore, the substantially same elements will be denoted by the same reference signs, and illustration and description thereof will be simplified or omitted. Mainly points different from the first embodiment will be described below.

Figure 10:
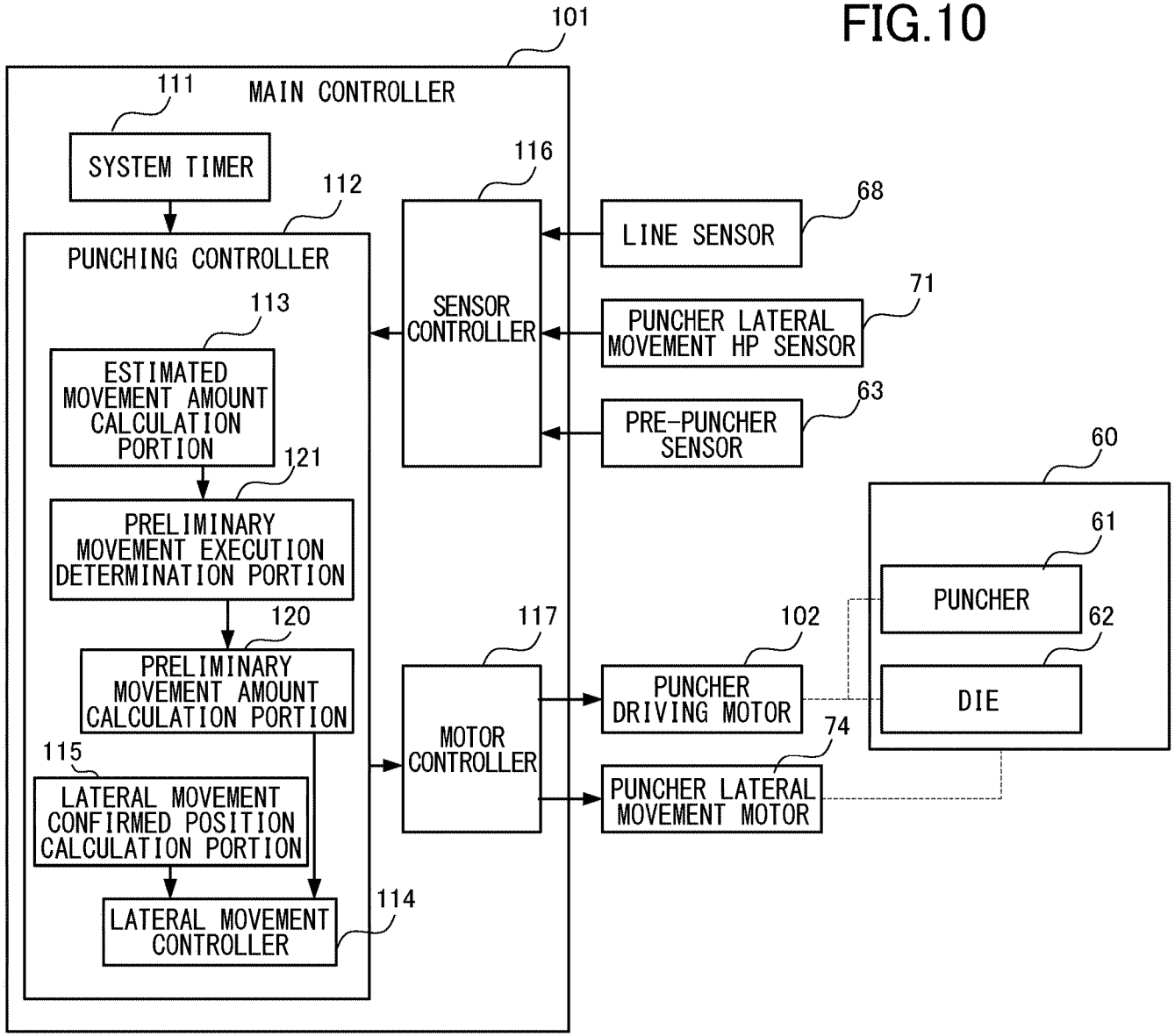
FIG. 10 is a block diagram illustrating a functional configuration of an image forming system according to a second embodiment.
Figure 11:
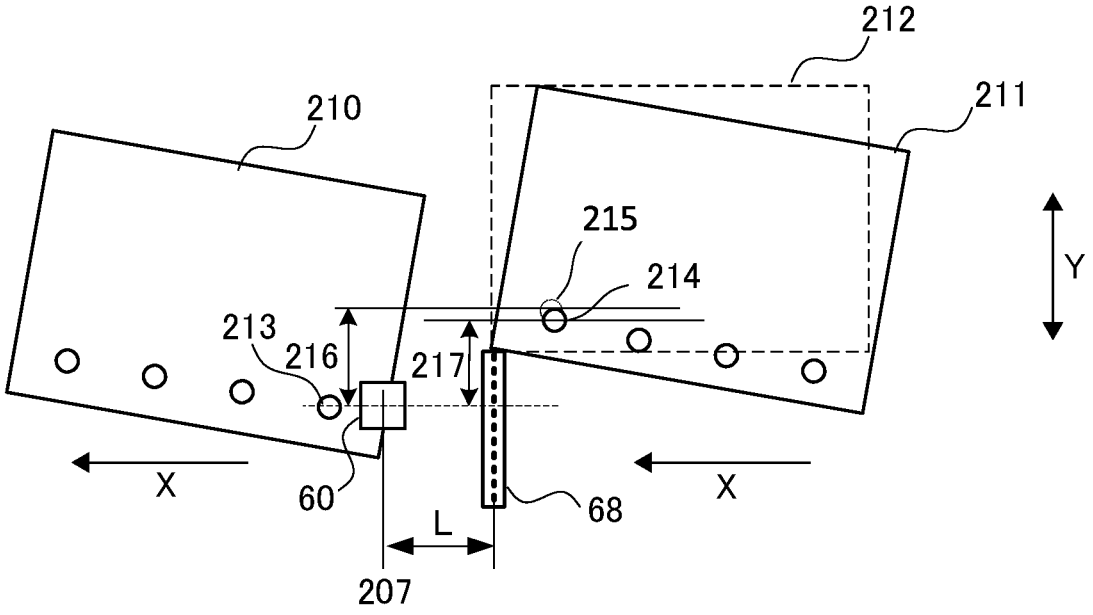
FIG. 11 is a schematic diagram illustrating a state in which a preceding sheet and a succeeding sheet are conveyed in a skewed state.

FIG. 10 is a block diagram illustrating a functional configuration of an image forming system of the present embodiment. This block diagram is different from the block diagram of the first embodiment illustrated in FIG. 5 in that a preliminary movement amount calculation portion 120 is added.

First, a problem of the case where the upper limit of the preliminary movement amount is equal to the estimated movement amount in the first embodiment will be described. FIG. 11 illustrates a case where a sheet is conveyed in a skewed state. A sheet can be conveyed in a skewed state depending on various factors such as the mechanical configuration of the apparatus, the use state of the rollers, and the state of the sheet. In this case, successively conveyed sheets are conveyed in similar skew angles. In FIG. 11, the value of the estimated movement amount calculated by measuring the left end position of the leading end of a succeeding sheet 212 with respect to a punching position 213 of a preceding sheet 210 by the line sensor 68 in the case where the succeeding sheet 212 is not conveyed in a skewed state is a distance 216. Here, since the punching position of the succeeding sheet is estimated on the premise that the succeeding sheet is not conveyed in a skewed state, the calculation is performed assuming that the succeeding sheet 212 is conveyed in a state indicated by a dot line in FIG. 11. Therefore, the punching position of the succeeding sheet 212 is estimated as a punching position 215.

However, in actuality, the succeeding sheet 211 is conveyed in a skewed state as indicated by a solid line. In the case where the punching position of the actual succeeding sheet 211 is confirmed by measuring the left end of the actual succeeding sheet 211 at the punching position thereof by the line sensor 68, the punching position is a position indicated as a punching position 214. If an amount equal to the estimated movement amount is set as the preliminary movement amount, in the case where inter-punching distance is large, the punching device 60 moves by the distance 216 in the preliminary movement, and the lateral movement thereof stops there. Then, if the punching position of the succeeding sheet 211 is confirmed by measuring the left end of the succeeding sheet 211 at the punching position by the line sensor 68, the punching position is confirmed as the punching position 214, and the movement amount from the punching position 213 of the preceding sheet 210 is a distance 217. This amount is smaller than the distance 216 calculated as the estimated movement amount.

In this case, if the punching device 60 moves by the distance 216 in the preliminary movement, the punching device 60 laterally moves in a direction opposite to the preliminary movement in the confirmed movement. In the case where sheets are conveyed in a skewed state as described above, the sheets are often successively conveyed in similar skew angles, and therefore the operation described above is repeated. As a result, the lateral movement amount of the punching device 60 becomes large. This increases the noise caused by the lateral movement of the punching device 60, and also increases the power consumption of the puncher lateral movement motor 74, which is a drive source of the lateral movement. In addition, in the case where there are constituent parts having lifetime corresponding to the lateral movement distance, the lifetime of those constituent parts is shortened.

The present embodiment can be preferably applied to an apparatus for which it is known in advance that sheets are successively conveyed in such skew angles that the distance 217 of the confirmed movement amount is smaller than the distance 216 of the estimated movement amount as described above. Therefore, in the present embodiment, the preliminary movement amount calculation portion 120 sets the upper limit of the preliminary movement amount to a value smaller than the estimated movement amount of the state in which the succeeding sheet is not skewed. In this case, the upper limit of the preliminary movement amount is set so as to satisfy the following. That is, the upper limit of the preliminary movement amount is set such that the remaining movement amount to reach the estimated movement amount is such a value that the lateral movement of the punching device 60 can be completed before the start of punching on the succeeding sheet even in the case where the lateral movement of the punching device 60 is started after the left end of the succeeding sheet at the punching position thereof is measured by the line sensor 68.

In this manner, excessive lateral movement can be avoided even if the sheet is conveyed in a skewed state. In addition, although the punching device 60 does not move by the distance 216 in the preliminary movement also in the case where the sheet is not skewed, that is, also in the case where the distance 217 of the confirmed movement amount is equal to the distance 216 of the preliminary movement amount, the remaining movement amount to the distance 216 is set to the amount described above. Therefore, the lateral movement of the punching device 60 for punching the succeeding sheet can be completed without a problem.

To be noted, in the present embodiment, an example in which the upper limit of the preliminary movement amount is set to an arbitrary value smaller than the estimated movement amount in the case where sheets are successively conveyed in similar skew angles, that is, in the case where the confirmed movement amount is smaller than the estimated movement amount, has been described.

However, depending on the configuration of the apparatus, there can be a case where the skew angles of the successively conveyed sheets are not similar. In this case, the confirmed movement amount can be larger than the estimated movement amount. In the case of such an apparatus configuration, the upper limit of the preliminary movement amount may be set on the basis of an assumed confirmed movement amount such that the lateral movement of the punching device 60 in the confirmed movement is completed before the start of the punching on the succeeding sheet. As described above, how the conveyed sheets are skewed differ between apparatuses, and therefore an optimal upper limit of the preliminary movement amount may be determined for each apparatus.

Third Embodiment

A third embodiment will be described with reference to FIGS. 12, 13A, and 13B. In each embodiment described above, the punching position of the succeeding sheet is estimated from the end portion of the succeeding sheet in the width direction at the leading end thereof detected by the line sensor 68. In contrast, in the present embodiment, the punching position of the succeeding sheet is estimated on the basis of information of the length of the preceding sheet and the succeeding sheet in the width direction. This information will be also referred to as sheet width information. The other elements and effects are substantially the same as those of the first embodiment described above. Therefore, the substantially same elements will be denoted by the same reference signs, and illustration and description thereof will be simplified or omitted. Mainly points different from the first embodiment will be described below.

Figure 12:
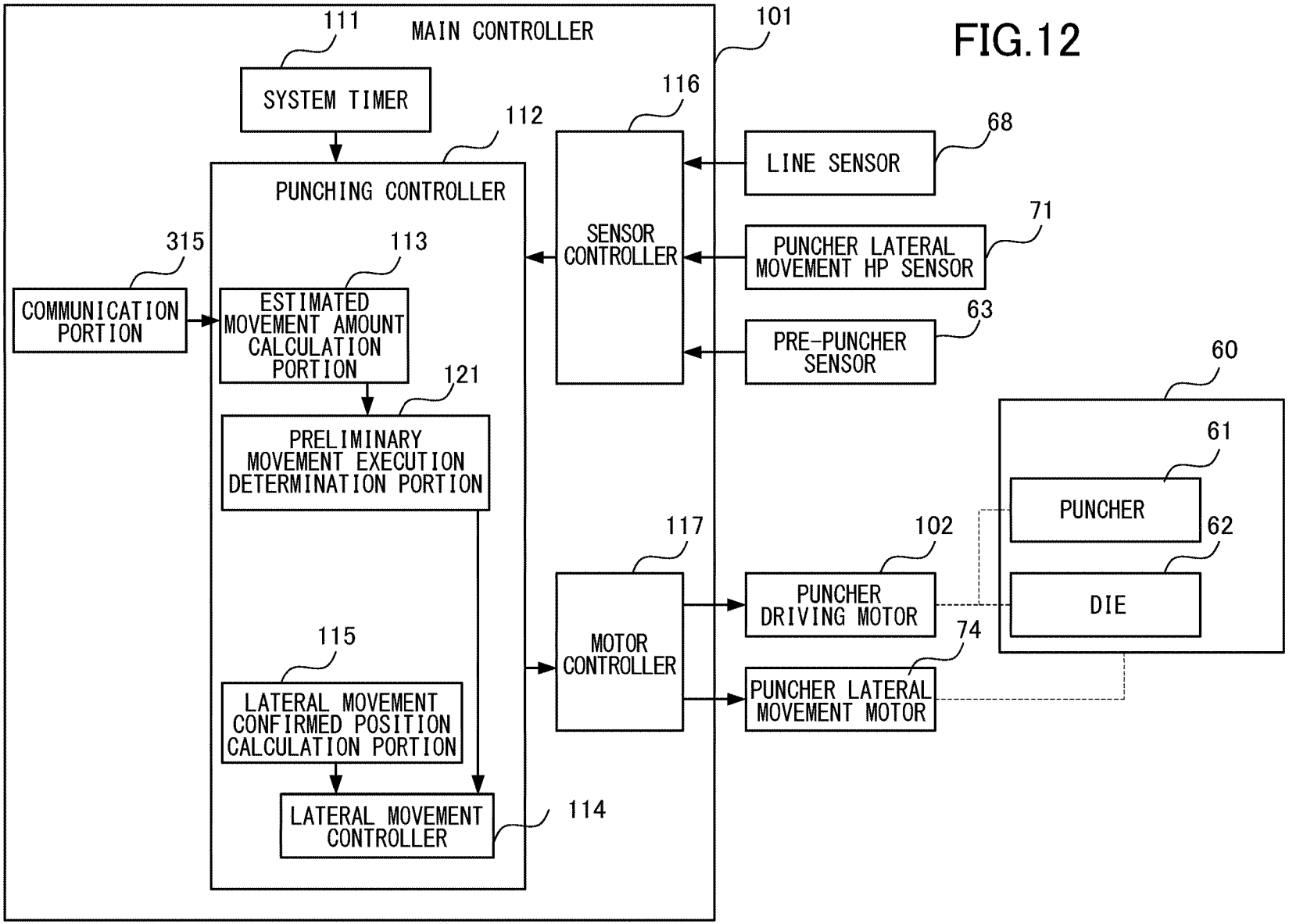
FIG. 12 is a block diagram illustrating a functional configuration of an image forming system according to a third embodiment.

FIG. 12 is a block diagram illustrating a functional configuration of an image forming system of the present embodiment. Unlike in the block diagram of the first embodiment illustrated in FIG. 5, the estimated movement amount calculation portion 113 receives sheet width information from the communication portion 315, and the estimated movement amount can be calculated on the basis of this sheet width information. To be noted, the estimated movement amount calculation portion 113 of the present embodiment also has the function of calculating the estimated movement amount by measuring the left end position of the succeeding sheet at the leading end thereof by the line sensor 68 similarly to the first and second embodiments.

Figure 13A:
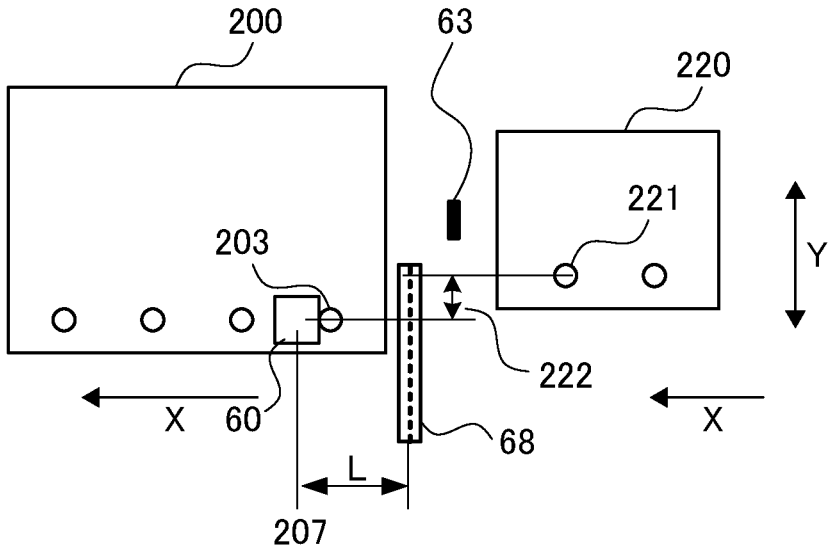
FIG. 13A is a schematic diagram illustrating a state in which a succeeding sheet having a width different from the width of a preceding sheet is conveyed and the leading end of the succeeding sheet has not reached a line sensor yet.
Figure 13B:
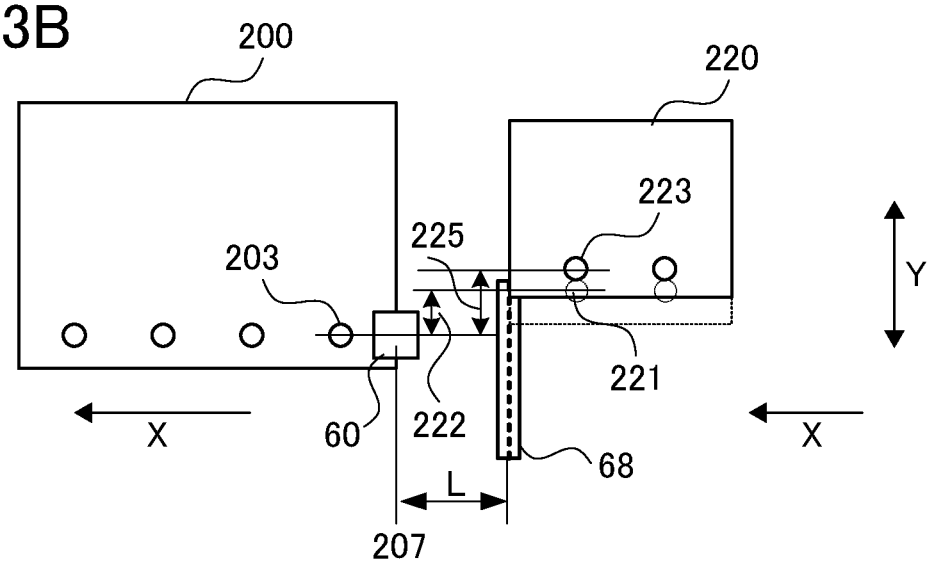
FIG. 13B is a schematic diagram illustrating a state in which a succeeding sheet having a width different from the width of a preceding sheet is conveyed and the leading end of the succeeding sheet has reached the line sensor.

FIGS. 13A and 13B illustrate a case where a succeeding sheet 220 has a smaller width than the preceding sheet 200, that is, has a smaller length than the preceding sheet 200 in the width direction, and the sheets of this combination are successively conveyed.

Conventionally, in most apparatuses, when successively printing sheets of different widths, to avoid heating of an end portion of the fixing unit, the interval between the successively conveyed sheets, that is, the so-called sheet interval is increased by a throughput down operation or the conveyance of sheets is temporarily stopped by a cycle down operation. However, according to recent technical advancement in fixing units and fixing control, apparatuses that successively convey sheets of different widths without increasing the sheet interval in successive printing of sheets of different widths have become more recognizable.

In the present embodiment, sheets are conveyed in a center-referenced manner, and therefore the punching position of a sheet is determined mainly in accordance with the sheet width thereof. To be noted, a "center-referenced" manner is a conveyance method in which conveyance is performed such that the center positions of successively conveyed sheets coincide.

In FIG. 13A, a punching position 221 of the succeeding sheet 220 is laterally displaced from the punching position 203 of the preceding sheet 200 by a distance 222. This distance 222 is calculated on the basis of the sheet widths of the preceding sheet 200 and the succeeding sheet 220. In the case where this distance 222 is larger than the maximum movement amount by which the punching device 60 can be laterally moved in a time in which a sheet is conveyed by the distance L from the line sensor 68 to the punching position thereof, the lateral movement cannot be completed before the start of the punching process on the succeeding sheet 220.

Therefore, in the present embodiment, the estimated movement amount calculation portion 113 obtains, via the communication portion 315, the sheet width information input from an external device or designated by a user, and the estimated punching position is determined on the basis of this sheet width information. That is, the main controller 101 estimates the punching position of the succeeding sheet 220 from the relationship between the length in the width direction, that is, the sheet width of the preceding sheet 200, and the sheet width of the succeeding sheet 220.

In the case where the length of the preceding sheet 200 in the width direction is different from the length of the succeeding sheet 220 in the width direction, the preliminary movement of the punching device 60 can be started at the following timing. That is, as in the first and second embodiments described above, the movement of the punching device 60 can be started on the basis of the information of the sheet width before the end portion position of the succeeding sheet 220 in the width direction at the leading end thereof reaches the line sensor 68. As a result of this, the lateral movement of the punching device can be completed by performing the preliminary movement without providing a large sheet interval even in the case of successive conveyance of sheets of different sheet widths.

To be noted, the estimated movement amount calculation portion 113 may update the estimated movement amount by measuring the left end position of the leading end of the succeeding sheet 220 by the line sensor 68 similarly to the first and second embodiments after calculating the estimated movement amount based on the sheet width information.

That is, the main controller 101 estimates the punching position of the succeeding sheet 220 from the relationship between the length of the preceding sheet 200 in the width direction and the length of the succeeding sheet 220 in the width direction. Then, a first estimated movement amount, which is a movement amount from the position of the punching device 60 at the end of the punching process on the preceding sheet 200 to the estimated punching position of the succeeding sheet 220, is calculated. In addition, the main controller 101 estimates the punching position of the succeeding sheet 220 from the end portion position of the succeeding sheet 220 in the width direction Y at the leading end thereof in the conveyance direction detected by the line sensor 68. Then, a second estimated movement amount, which is a movement amount from the position of the punching device 60 at the end of the punching process on the preceding sheet 200 to the estimated punching position of the succeeding sheet 220, is calculated. The main controller 101 causes one or more of first preliminary movement in which the preliminary movement is performed on the basis of the first estimated movement amount and second preliminary movement in which the preliminary movement is performed on the basis of the second estimated movement amount.

For example, the main controller 101 starts the first preliminary movement after the punching process on the preceding sheet 200 is finished and before the end portion position of the succeeding sheet 220 in the width direction Y at the leading end thereof in the conveyance direction X reaches the line sensor 68. Then, the second preliminary movement is performed after the end portion position of the succeeding sheet 220 in the width direction Y at the leading end thereof in the conveyance direction X reaches the line sensor 68.

This state is illustrated in FIG. 13B. The distance 222 is the estimated movement amount based on the sheet width information serving as the first estimated movement amount. Since there is a possibility that the actual conveyance position of the succeeding sheet 220 is displaced in the lateral direction, a punching position 223 is estimated by measuring the left end position of the leading end portion of the succeeding sheet 220 by the line sensor 68. A distance 225 is the estimated movement amount obtained by measurement by the line sensor 68 serving as the second estimated movement amount.

Displacement of punching position derived from the sheet width itself is estimated by using the sheet width information, and displacement of punching position derived from sheet conveyance is estimated by using a measurement value of a line sensor. By sequentially performing the preliminary movement on the basis of each estimation, punching can be performed with high accuracy without increasing the sheet interval even in the case of successively conveying sheets of different sheet widths.

Other Embodiments

Although the preliminary movement is started at a timing at which the leading end of the succeeding sheet reaches the line sensor, the preliminary movement may be started at a timing at which any position between the leading end of the succeeding sheet and the punching position reaches the line sensor. In short, the preliminary movement may be started at any timing as long as the preliminary movement can be started before the end portion position of the succeeding sheet in the width direction at the punching position reaches the line sensor. As a result of this, the movement of the punching device can be completed even in the case where the distance L from the line sensor to a predetermined position at which punching is performed by the punching device is smaller than in the case where the movement of the punching device is started after the end portion position of the succeeding sheet at the punching position is detected by the line sensor.

Although a case where the main controller 101 serving as a controller is included in a sheet processing apparatus has been described, the controller may be included in an image forming apparatus instead of in the sheet processing apparatus.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-041338, filed Mar. 10, 2020 which is hereby incorporated by reference herein in its entirety.

What is claimed is:

1. A sheet processing apparatus comprising:

sheet conveyance portion configured to convey a sheet in a conveyance direction;

a punching member that is rotatably supported and configured to perform a punching process of punching a hole in the sheet conveyed by the sheet conveyance portion in a predetermined position in the conveyance direction;

a punching member moving portion configured to move the punching member in a sheet width direction perpendicular to the conveyance direction;

a position detection portion disposed upstream of the predetermined position in the conveyance direction and configured to detect a position of a side end portion of the sheet in the sheet width direction; and a controller configured to control the punching member moving portion to move the punching member to a position to punch the hole in the sheet, wherein, in a case of performing the punching process on a preceding sheet and a succeeding sheet successively conveyed to the predetermined position, the controller is configured to execute preliminary movement after the punching process on the preceding sheet is finished and before a first portion of the succeeding sheet reaches the position detection portion, wherein the first portion of the succeeding sheet is a part of the side end portion located at a position in the conveyance direction that coincides with a first punching position of the succeeding sheet in the conveyance direction, wherein the first punching position is a position where the punching process is first performed on the succeeding sheet, wherein, in the preliminary movement, movement of the punching member in the sheet width direction is started for performing the punching process on the succeeding sheet, wherein in the preliminary movement, the controller is configured to start the movement of the punching member at a timing when a second portion of the succeeding sheet reaches the position detection portion, and wherein the second portion of the succeeding sheet is a part of the side end portion located downstream of the first portion in the conveyance direction.

2. The sheet processing apparatus according to claim 1, wherein the second portion of the succeeding sheet is a leading end part in the conveyance direction of the side end portion.

3. The sheet processing apparatus according to claim 1, wherein, in a case where a length of the preceding sheet in the sheet width direction is different from a length of the succeeding sheet in the sheet width direction, in the preliminary movement, the controller starts the movement of the punching member before a leading end of the succeeding sheet in the conveyance direction reaches the position detection portion.

4. The sheet processing apparatus according to claim 1, wherein, in the case of performing the punching process on the preceding sheet and the succeeding sheet successively conveyed to the predetermined position, the controller estimates the first punching position of the succeeding sheet on a basis of a position of the second portion of the succeeding sheet detected by the position detection portion, before a position of the first portion of the succeeding sheet in the sheet width direction is detected by the position detection portion, and wherein the preliminary movement is an operation of starting moving the punching member toward the estimated first punching position.

5. The sheet processing apparatus according to claim 4, wherein the controller executes the preliminary movement in a case where an estimated movement amount that is a movement amount from a position of the punching member at an end of the punching process on the preceding sheet to the estimated first punching position is larger than a predetermined threshold value, and does not execute the preliminary movement in a case where the estimated movement amount is equal to or smaller than the predetermined threshold value.

6. The sheet processing apparatus according to claim 5, wherein the predetermined threshold value is equal to or larger than a maximum movement amount by which the punching member moving portion is capable of moving the punching member in a time from a time point at the position of the first portion of the succeeding sheet in the sheet width direction is detected by the position detection portion to a start of the punching process on the succeeding sheet at the first punching position.

7. The sheet processing apparatus according to claim 4, wherein the controller confirms the first punching position of the succeeding sheet in a case where the position of the first portion of the succeeding sheet in the sheet width direction has been detected by the position detection portion.

8. The sheet processing apparatus according to claim 7, wherein the controller stops the preliminary movement in a case where a movement amount in the preliminary movement has reached a predetermined upper limit value after the preliminary movement is started and before the first punching position of the succeeding sheet is confirmed.

9. The sheet processing apparatus according to claim 8, wherein the predetermined upper limit value is equal to an estimated movement amount from a position of the punching member at an end of the punching process on the preceding sheet to the estimated first punching position.

10. The sheet processing apparatus according to claim 8, wherein the predetermined upper limit value is capable of being set to an arbitrary value.

11. The sheet processing apparatus according to claim 7, wherein, in a case where the position of the first portion of the succeeding sheet in the sheet width direction has been detected by the position detection portion during the preliminary movement, the controller confirms the first punching position, and moves the punching member to the confirmed first punching position regardless of the estimated first punching position.

12. The sheet processing apparatus according to claim 4, wherein the controller estimates the first punching position of the succeeding sheet on a basis of a position of the second portion of the succeeding sheet in the sheet width direction detected by the position detection portion.

13. The sheet processing apparatus according to claim 4, wherein the controller estimates the first punching position of the succeeding sheet from a relationship between a length of the preceding sheet in the sheet width direction and a length of the succeeding sheet in the sheet width direction.

14. The sheet processing apparatus according to claim 4, wherein the controller estimates the first punching position of the succeeding sheet from a relationship between a length of the preceding sheet in the sheet width direction and a length of the succeeding sheet in the sheet width direction, calculates a first estimated movement amount that is a movement amount from a position of the punching member at an end of the punching process on the preceding sheet to the first punching position estimated from the relationship, estimates the first punching position of the succeeding sheet on a basis of a position of the second portion of the succeeding sheet in the sheet width direction detected by the position detection portion, calculates a second estimated movement amount that is a movement amount from a position of the punching member at an end of the punching process on the preceding sheet to the first punching position estimated on a basis of the position of the second portion, and executes at least one of first preliminary movement in which the preliminary movement is executed on a basis of the first estimated movement amount and second preliminary movement in which the preliminary movement is executed on a basis of the second estimated movement amount.

15. The sheet processing apparatus according to claim 14, wherein the controller starts the first preliminary movement after the punching process on the preceding sheet is finished and before the second portion of the succeeding sheet in the conveyance direction reaches the position detection portion, and executes the second preliminary movement after the second portion of the succeeding sheet in the conveyance direction reaches the position detection portion.

16. The sheet processing apparatus according to claim 1, further comprising a sheet leading end detection portion disposed upstream of the position detection portion in the conveyance direction and configured to detect a leading end of the sheet in the conveyance direction, wherein the controller detects the position of the side end portion of the sheet in the sheet width direction by the position detection portion on a basis of a timing of detection of the leading end of the sheet by the sheet leading end detection portion.

17. The sheet processing apparatus according to claim 1, wherein the punching member moving portion comprises:

a drive source controlled by the controller; and a movement mechanism configured to move the punching member in the sheet width direction by a drive of the drive source, and wherein the drive source is a stepping motor.

18. The sheet processing apparatus according to claim 1, wherein the position detection portion is a line sensor in which a plurality of image sensors are arranged in the sheet width direction.

19. A sheet processing apparatus comprising:

a sheet conveyance portion configured to convey a sheet in a conveyance direction;

a punching member that is rotatably supported and configured to perform a punching process of punching a hole in the sheet conveyed by the conveyance portion in a predetermined position in the conveyance direction;

a punching member moving portion configured to move the punching member in a sheet width direction perpendicular to the conveyance direction;

a position detection portion disposed upstream of the predetermined position in the conveyance direction and configured to detect an end portion position of the sheet in the sheet width direction; and a controller configured to control the punching member moving portion to move the punching member to a position to punch the hole in the sheet, wherein, in a case of performing the punching process on a preceding sheet and a succeeding sheet successively conveyed to the predetermined position, the controller starts moving the punching member in the sheet width direction to perform the punching process on the succeeding sheet, after the punching process on the preceding sheet is finished and before an end portion position of the succeeding sheet in the sheet width direction that coincides with a first punching position of the succeeding sheet in the conveyance direction reaches the position detection portion, in a case where a distance from a position of the punching member at an end of the punching process on the preceding sheet to the first punching position of the succeeding sheet in the sheet width direction is larger than a predetermined threshold value, the first punching position being a position where the punching process is first performed on the succeeding sheet, and starts moving the punching member in the sheet width direction to perform the punching process on the succeeding sheet, after the end portion position of the succeeding sheet in the sheet width direction that coincides with the first punching position of the succeeding sheet in the conveyance direction reaches the position detection portion, in a case where the distance from the position of the punching member at the end of the punching process on the preceding sheet to the first punching position of the succeeding sheet in the sheet width direction is equal to or smaller than the predetermined threshold value.

20. An image forming system comprising:

an image forming apparatus configured to form an image on a sheet; and the sheet processing apparatus according to claim 1 configured to receive the sheet from the image forming apparatus and perform a punching process on the sheet.

21. A sheet processing apparatus comprising:

a sheet conveyance portion configured to convey a sheet in a conveyance direction;

a punching member that is rotatably supported and configured to perform a punching process of punching a hole in the sheet conveyed by the sheet conveyance portion in a predetermined position in the conveyance direction;

a punching member moving portion configured to move the punching member in a sheet width direction perpendicular to the conveyance direction;

a position detection portion disposed upstream of the predetermined position in the conveyance direction and configured to detect a position of a side end portion of the sheet in the sheet width direction; and a controller configured to control the punching member moving portion to move the punching member to a position to punch the hole in the sheet, wherein, in a case of performing the punching process on a preceding sheet and a succeeding sheet successively conveyed to the predetermined position, the controller is configured to execute preliminary movement after the punching process on the preceding sheet is finished and before a first portion of the succeeding sheet reaches the position detection portion, wherein the first portion of the succeeding sheet is a part of the side end portion located at a position in the conveyance direction that coincides with a first punching position of the succeeding sheet in the conveyance direction, wherein the first punching position is a position where the punching process is first performed on the succeeding sheet, wherein, in the preliminary movement, movement of the punching member in the sheet width direction is started for performing the punching process on the succeeding sheet, wherein the controller is configured to:

estimate the first punching position of the succeeding sheet before a position of the first portion of the succeeding sheet is detected by the position detection portion on a basis of a position of a second portion of the succeeding sheet detected by the position detection portion, wherein the second portion of the succeeding sheet is a part of the side end portion that is located downstream of the first portion in the conveyance direction;

execute the preliminary movement in a case where an estimated movement amount that is a movement amount from a position of the punching member at an end of the punching process on the preceding sheet to the estimated first punching position estimated on the basis of the position of the second portion is larger than a predetermined threshold value; and not execute the preliminary movement in a case where the estimated movement amount estimated on the basis of the position of the second portion is equal to or smaller than the predetermined threshold value.

22. The sheet processing apparatus according to claim 1, wherein the controller is configured to move the punching member, in the preliminary movement, toward an estimated first punching position estimated on a basis of a position of the second portion of the succeeding sheet detected by the position detection portion, and move the punching member, after the preliminary movement and before the punching process is first performed on the succeeding sheet, to the first punching position on a basis of a position of the first portion of the succeeding sheet detected by the position detection portion regardless of the estimated first punching position.

* * * * *